US009138035B2

(12) United States Patent
Stochetti

(10) Patent No.: US 9,138,035 B2
(45) Date of Patent: Sep. 22, 2015

(54) FLEXIBLE CANOPY

(71) Applicant: Adrian Smith + Gordon Gill Architecture LLP, Chicago, IL (US)

(72) Inventor: Alejandro H. Stochetti, Chicago, IL (US)

(73) Assignee: Adrian Smith + Gordon Gill Architecture LLP, Chicago, IL (US)

( * ) Notice: Subject to any disclaimer, the term of this patent is extended or adjusted under 35 U.S.C. 154(b) by 0 days.

(21) Appl. No.: 13/674,527

(22) Filed: Nov. 12, 2012

(65) Prior Publication Data

US 2014/0130836 A1 May 15, 2014

(51) Int. Cl.

| | |
|---|---|
| ***A45B 19/00*** | (2006.01) |
| ***A45B 25/02*** | (2006.01) |
| *A45B 11/00* | (2006.01) |

(52) U.S. Cl.

CPC ..... *A45B 19/00* (2013.01); *A45B 25/02* (2013.01); *A45B 2011/005* (2013.01); *A45B 2019/001* (2013.01); *A45B 2019/008* (2013.01)

(58) Field of Classification Search

CPC .. A45B 19/00; A45B 25/14; A45B 2019/008; A45B 19/001

USPC ..... 135/20.3, 19.5, 31, 26

See application file for complete search history.

(56) References Cited

U.S. PATENT DOCUMENTS

| | | | | |
|---|---|---|---|---|
| 854,663 | A * | 5/1907 | McGuire | 135/27 |
| 1,316,421 | A | 9/1919 | Cannon, Jr. | |
| 1,356,263 | A | 10/1920 | Cannon, Jr. et al. | |
| 1,356,264 | A | 10/1920 | Cannon, Jr. et al. | |
| 1,356,265 | A | 10/1920 | Cannon, Jr. et al. | |
| 1,559,332 | A | 2/1924 | Lutz et al. | |
| 2,024,946 | A * | 12/1935 | Morgenstern | 135/15.1 |
| 2,221,289 | A | 4/1940 | Okun | |
| 2,492,376 | A | 12/1949 | Brillas | |
| 2,666,442 | A | 1/1954 | Fortner | |
| 2,788,792 | A * | 4/1957 | Koller | 135/15.1 |

(Continued)

FOREIGN PATENT DOCUMENTS

| | | | | |
|---|---|---|---|---|
| DE | 102010060149 | * | 4/2012 | |
| DE | 102010060149 A | * | 4/2012 | A45B 19/00 |

(Continued)

OTHER PUBLICATIONS

International Search Report and Written Opinion for International Application No. PCT/US13/66372 dated Mar. 19, 2014. (8 pages).

*Primary Examiner* — Noah Chandler Hawk

(74) *Attorney, Agent, or Firm* — Neal, Gerber & Eisenberg LLP

(57) ABSTRACT

Various embodiments of the present disclosure provide a flexible canopy. In one embodiment, the flexible canopy includes a central shaft, a sliding collar, a plurality of supports, a plurality of tensioners, a tensioner connection hub, and a membrane. The sliding collar is slidably connected to and surrounds the central shaft. A first end of each of the supports is connected to the sliding collar, and a second end of each of the supports is connected to the membrane near the edge of the membrane. Each of the tensioners is connected at one end to a different one of the supports and at the other end to the tensioner connection hub. In one embodiment, the flexible canopy includes a handle connected to a first, lower end of the central shaft. In other embodiments, the first, lower end of the central shaft includes or is insertable into a base.

27 Claims, 35 Drawing Sheets

(56) References Cited

U.S. PATENT DOCUMENTS

| | | | | |
|---|---|---|---|---|
| 3,171,418 | A | 3/1965 | Meyer | |
| 3,435,836 | A * | 4/1969 | Vanzini | 135/22 |
| 3,467,114 | A * | 9/1969 | McSherry | 135/126 |
| 3,534,752 | A * | 10/1970 | Vanzini | 135/22 |
| 3,709,238 | A * | 1/1973 | Leopoldi et al. | 135/15.1 |
| 3,765,433 | A * | 10/1973 | Futamura et al. | 135/15.1 |
| 3,949,962 | A | 4/1976 | Wilson | |
| 4,821,756 | A | 4/1989 | England | |
| 4,834,126 | A | 5/1989 | Sweet, Jr. | |
| 5,188,137 | A | 2/1993 | Simonelli | |
| 6,209,556 | B1 | 4/2001 | Yu | |
| 6,234,185 | B1 | 5/2001 | Tidd | |
| 6,273,111 | B1 | 8/2001 | Weiss et al. | |
| 6,286,528 | B1 | 9/2001 | Corso et al. | |
| 6,766,814 | B2 | 7/2004 | Perreault | |
| 6,918,399 | B2 * | 7/2005 | Ko | 135/29 |
| 6,941,959 | B2 | 9/2005 | Kung-Tai | |
| 7,484,518 | B2 | 2/2009 | Brader | |
| 7,992,581 | B2 * | 8/2011 | Hoogendoorn | 135/31 |
| 8,225,806 | B1 | 7/2012 | Simonelli | |
| 8,667,975 | B1 * | 3/2014 | Chessum | 135/25.4 |
| 2003/0089388 | A1 * | 5/2003 | Cassagne | 135/25.32 |
| 2005/0045216 | A1 * | 3/2005 | Nicholas et al. | 135/19 |
| 2008/0006313 | A1 | 1/2008 | Wang | |
| 2009/0223545 | A1 | 9/2009 | Beyer et al. | |
| 2010/0031984 | A1 * | 2/2010 | Oh | 135/25.4 |
| 2011/0259382 | A1 | 10/2011 | Dalo | |
| 2012/0006367 | A1 | 1/2012 | Chang et al. | |

FOREIGN PATENT DOCUMENTS

| | | | |
|---|---|---|---|
| EP | 1005804 | A1 * | 6/2000 |
| EP | 2082662 | A2 * | 7/2009 |
| EP | 2443957 | A1 * | 4/2012 |
| GB | 2481001 | A * | 12/2011 |

* cited by examiner

FLEXIBLE CANOPY

BACKGROUND

Canopies are well known, and are typically used to shield a user or users from sun, rain, sleet, snow, wind, and other weather conditions. Many known canopies include a membrane supported by a plurality of generally rigid foldable supports mounted to a central shaft. When the canopy is in a folded configuration, the membrane is folded upon itself such that the canopy may be easily stored. When the canopy is in an unfolded configuration, the membrane forms a domed or a flat shape that protects the user(s) from the elements.

Known canopies come in various shapes and sizes. One relatively large type of known canopy is sun canopy or a patio umbrella that includes a base or stand configured to hold the sun canopy in a generally upright orientation. In certain instances, the base or stand is movable, while in other instances the base or stand is immovable (such as encased in concrete). Such known sun canopies are normally configured to shield multiple users and/or furniture from sun, rain, and the like. One relatively small type of known canopy is a handheld umbrella that includes a handle. Such known handheld umbrellas are normally configured to be held by a single user to shield that user from sun, rain, and the like.

In certain instances when a typical sun canopy or a typical handheld umbrella is being used to shield its user(s) from the elements, such as during a thunderstorm, a strong gust of wind may cause the membrane to invert or otherwise deform, which often causes one or more of the generally rigid foldable supports to snap or bend. This renders the sun canopy or the handheld umbrella useless, requiring the user to throw it in the trash and either purchase a new sun canopy or handheld umbrella or brave the elements without one. Due to the widespread, frequent use of canopies such as sun canopies and handheld umbrellas, particularly for protection from the elements, there is a continuing need to provide new and improved canopies that resist breakage.

SUMMARY

Various embodiments of the present disclosure provide a canopy that is made of generally flexible materials, which solves the above-described breakage problem. Particularly, the flexible canopy of the present disclosure includes flexible tensioners rather than rigid, foldable supports that are easily broken or deformed.

In certain embodiments, the flexible canopy is an umbrella including a central shaft having a first, lower end and a second, upper end; a sliding collar; a plurality of supports each having a first, lower end and a second, upper end; a plurality of sheaths each having a first, lower end and a second, upper end; a plurality of tensioners each having a first, lower end and a second, upper end; a membrane having an upper surface and a lower surface; and a tensioner connection hub.

The sliding collar is slidably connected to and surrounds the central shaft above the handle, and the tensioner connection hub is connected to and surrounds the central shaft above the sliding collar near the second, upper end of the central shaft. For each of the supports, the first, lower end of that support is connected to the sliding collar and the second, upper end of that support is connected to the interior of the second, upper end of one of the sheaths. Additionally, for each of the supports, that support passes through the tensioner connection hub. For each of the sheaths, the first, lower end of that sheath is attached to the tensioner connection hub. Each of the sheaths is also connected at one or more points to the lower surface of the membrane. Each of the tensioners is connected at its second, upper end to a different one of the sheaths and at its first, lower end to the tensioner connection hub.

The supports are thin, flexible rods that have a normal undeformed shape that, in these embodiments, is a substantially straight line. When the supports are bent or deformed away from their normal undeformed shapes, the supports are biased to return to their normal undeformed shapes. The tensioners, on the other hand, are completely flexible and do not have a normal undeformed shape. Thus, when the tensioners are bent, twisted, or otherwise deformed, the tensioners are not biased to return to any particular shape and, since they are not made of a rigid material in these embodiments, will not snap or permanently deform.

In one such embodiment, the flexible umbrella includes a handle connected to the first, lower end of the central shaft. In another such embodiment, the flexible umbrella includes a base or stand connected to the first, lower end of the central shaft. In another such embodiment, the first, lower end of the central shaft is insertable into a base or stand.

In other embodiments, the flexible canopy is an umbrella including a hollow central shaft having a first, lower end and a second, upper end including a sliding surface; a sliding collar; a plurality of supports each having a first, lower end and a second, upper end; a plurality of sheaths each having a first, lower end and a second, upper end; a plurality of tensioners each having a first end and a second end; a first membrane having an upper surface and a lower surface; and a second membrane having an upper surface and a lower surface.

The sliding collar is slidably connected to and surrounds the central shaft. The central shaft has one or more slits or openings spanning a portion of the length of the central shaft such that a portion of the sliding collar is positioned within the hollow portion of the central shaft. The second, upper end of the central shaft includes the sliding surface along which the tensioners slide when the flexible umbrella is folded and unfolded.

Each of the supports is covered by a sheath. The second, upper end of each sheath is connected to an exterior surface of the central shaft near the second, upper end of the central shaft. Each sheath is also connected at one or more points to the lower surface of the first membrane, which has a substantially annular shape in these embodiments. The inner edge of the first membrane is connected to the second, upper end of the central shaft near where the second, upper ends of the sheaths are connected to the central shaft. The second membrane, which has a substantially circular shape in these embodiments, is positioned such that it covers the upper end of the central shaft and overlaps with the first membrane, and such that the tensioners pass between the bottom surface of the second membrane and the upper surface of the first membrane. Each tensioner is connected at its first end to the portion of the sliding collar positioned within the hollow portion of the central shaft and at its second end to one of the sheaths.

In one such embodiment, the flexible umbrella includes a handle connected to the first, lower end of the central shaft. In another such embodiment, the flexible umbrella includes a base or stand connected to the first, lower end of the central shaft. In another such embodiment, the first, lower end of the central shaft is insertable into a base or stand.

In further embodiments, the flexible canopy is an umbrella including a central shaft having a first, lower end and a second, upper end; a sheath securing hub; a sliding collar; a plurality of supports each having a first, lower end and a second, upper end; a plurality of sheaths each having a first, lower end and a second, upper end; a plurality of tensioners each having a first, lower end and a second, upper end; a membrane having an upper surface and a lower surface; and a restrainer.

The sheath securing hub is connected to and surrounds the central shaft near the second, upper end of the central shaft, and the sliding collar is slidably connected to and surrounds the central shaft below the sheath securing hub. Each support is covered by one of the sheaths. The first, lower end of each of the sheaths is connected to the sheath securing hub, and the second, upper end of each of the sheaths is connected to the lower surface of the membrane. Each tensioner is connected at its first, lower end to the sliding collar and at its second, upper end to one of the sheaths. The restrainer is connected to the central shaft at a designated position along the central shaft. The restrainer surrounds the central shaft, the sheaths and supports within, and the tensioners.

In one such embodiment, the flexible umbrella includes a handle connected to the first, lower end of the central shaft. In another such embodiment, the flexible umbrella includes a base or stand connected to the first, lower end of the central shaft. In another such embodiment, the first, lower end of the central shaft is insertable into a base or stand.

Additional features and advantages are described herein, and will be apparent from the following Detailed Description and the Figures.

DETAILED DESCRIPTION OF EXAMPLE EMBODIMENTS

Various example embodiments of the flexible canopy of the present disclosure are described below and illustrated in the accompanying Figures. More specifically, the example flexible canopies described below and illustrated in the accompanying Figures are flexible umbrellas including handles. As described below, it should be appreciated that the present disclosure is not limited to flexible umbrellas including handles.

First Example Embodiment

Figure 1:
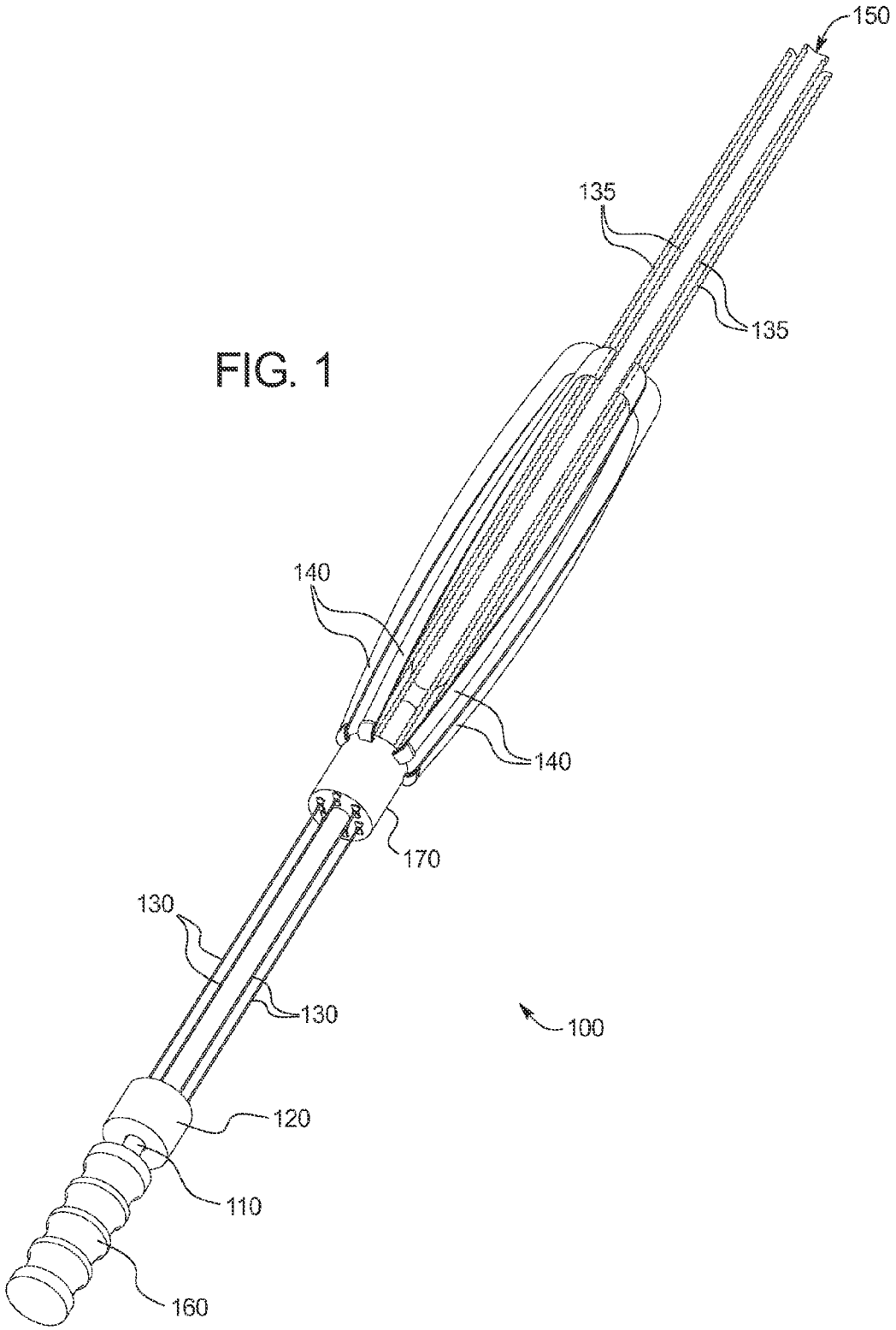
FIG. 1 is a bottom perspective view of one example embodiment of the flexible umbrella of the present disclosure in a closed or folded configuration.
Figure 2:
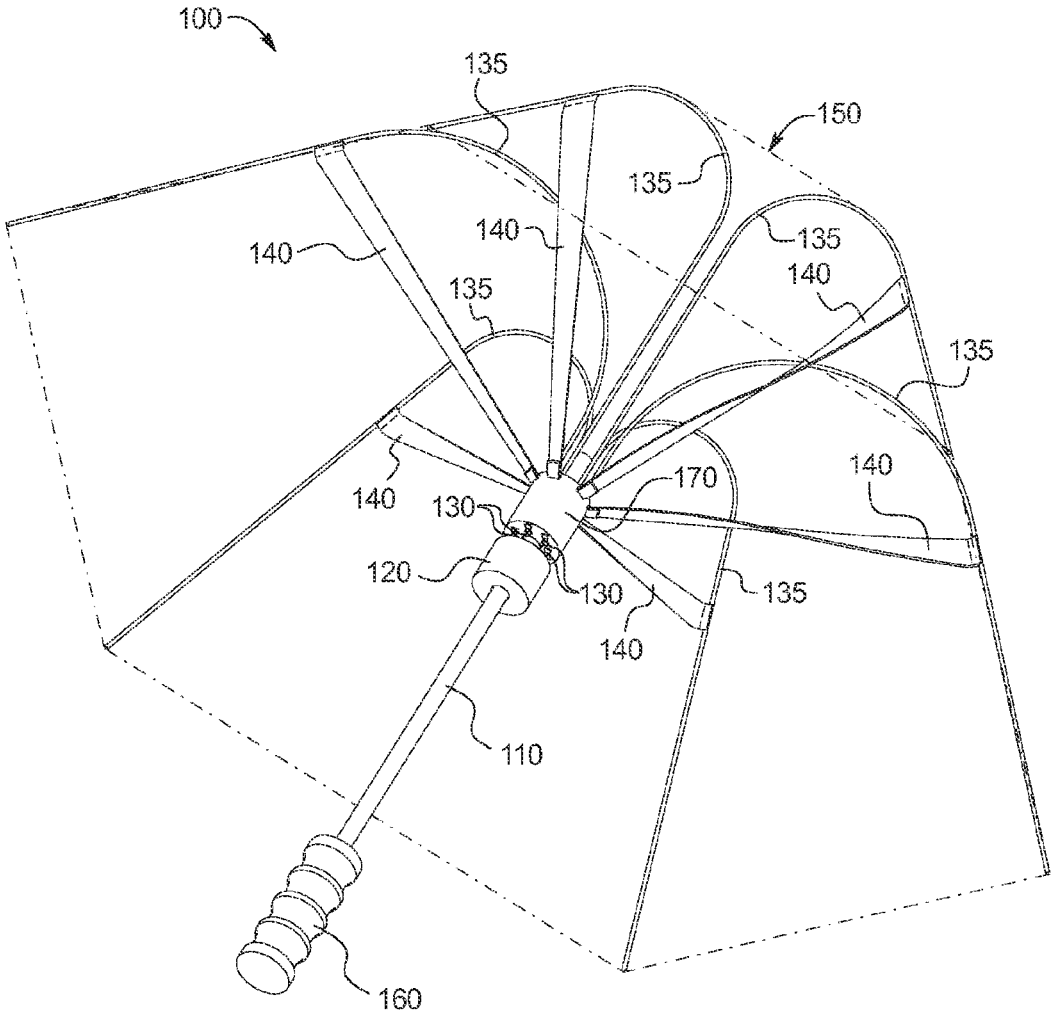
FIG. 2 is a bottom perspective view of the embodiment of the flexible umbrella of FIG. 1 in an open or unfolded configuration.
Figure 3:
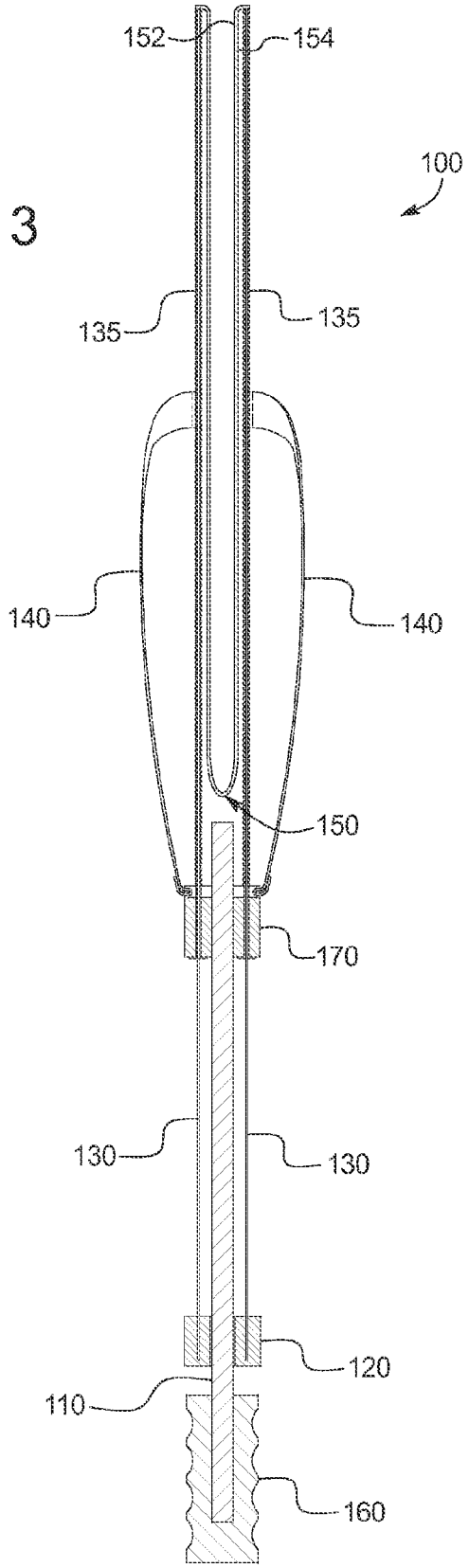
FIG. 3 is a cross-sectional view of the flexible umbrella of FIG. 1 in the folded configuration.
Figure 3A:
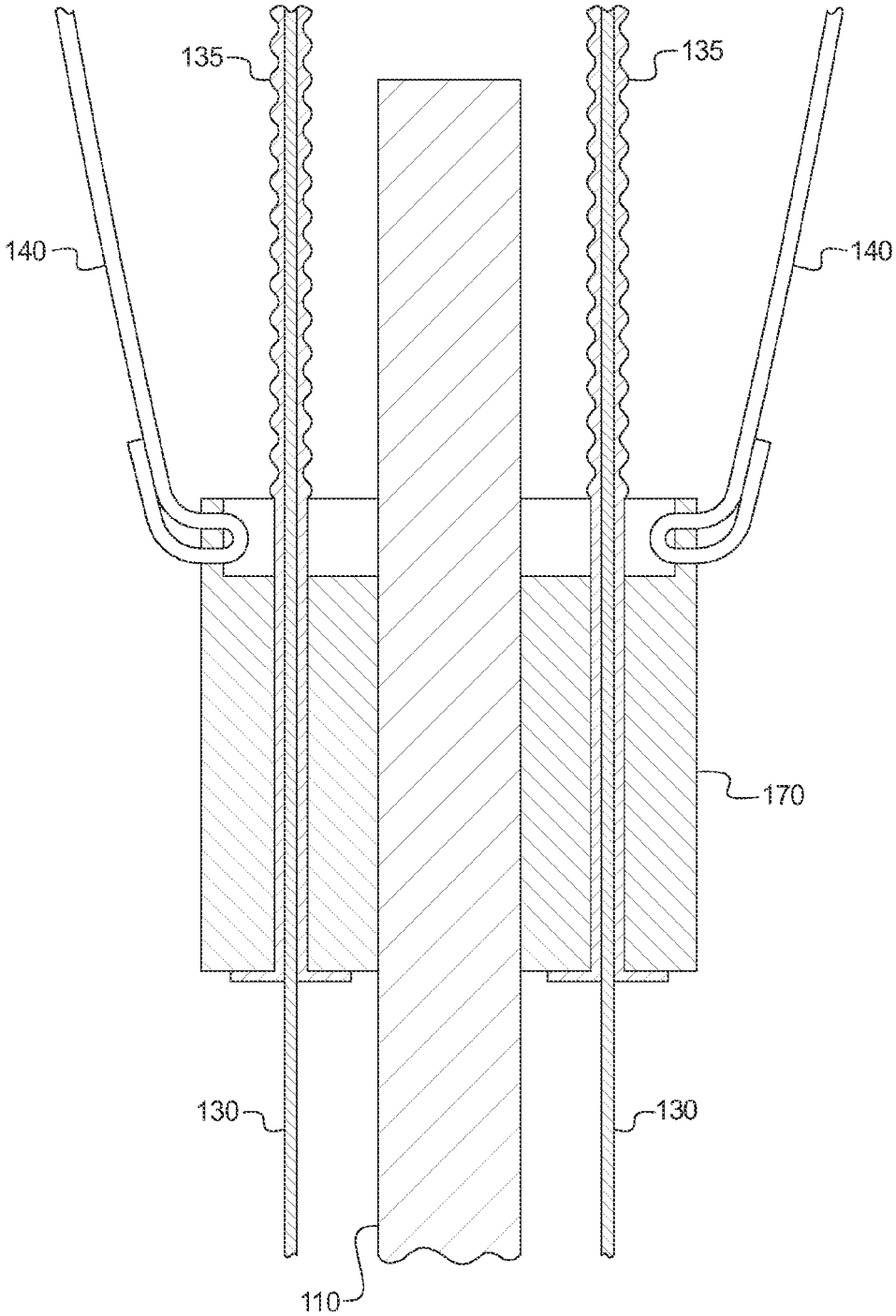
FIG. 3A is an enlarged cross-sectional view of the flexible umbrella of FIG. 1 in the folded configuration.

Turning now to the Figures and particularly to FIGS. 1, 2, 3, 3A, 4, and 5, one example embodiment of the flexible umbrella of the present disclosure is illustrated and generally indicated by numeral 100. In this embodiment, the flexible umbrella 100 includes a central shaft 110 having a first, lower end and a second, upper end; a sliding collar 120; a plurality of supports 130 each having a first, lower end and a second, upper end; a plurality of sheaths 135 each having a first, lower end and a second, upper end; a plurality of tensioners 140 each having a first, lower end and a second, upper end; a membrane 150 having an upper surface 152 and a lower surface 154; a handle 160; and a tensioner connection hub 170. As best illustrated in FIG. 3A, in this embodiment the tensioner connection hub 170 has a plurality of vertical bores therethrough and a plurality of radially spaced sets of upper and lower tensioner receiving slots.

The handle 160 is connected to the first, lower end of the central shaft 110; the sliding collar 120 is slidably connected to and surrounds the central shaft 110 above the handle 160; and the tensioner connection hub 170 is connected to and surrounds the central shaft 110 above the sliding collar 120 near the second, upper end of the central shaft 110. In this embodiment, the central shaft is solid (though it should be appreciated that the central shaft is hollow in other embodiments) and made of a flexible material, such as fiberglass, or a more rigid material, such as plastic or aluminum; the sliding collar is made of a plastic composite or a metal such as aluminum; and the handle is made of a plastic composite, rubber, wood (natural or composite), or metal.

For each of the supports 130, the first, lower end of that support 130 is connected to the sliding collar 120 (such as via an interference fit) and the second, upper end of that support 130 is connected to the interior of the second, upper end of one of the sheaths 135 (such as via sewing). Additionally, for each of the supports 130, that support 130 passes through one of the vertical bores through the tensioner connection hub 170, as best shown in FIG. 3A. For each of the sheaths 135, the first, lower end of that sheath 135 protrudes out of the bottom of its respective vertical bore through the tensioner connection hub 170, and attaches to a bottom surface of the tensioner connection hub 170, as best shown in FIG. 3A. Put differently, each sheath covers a portion of its corresponding support extending from the second, upper end of that support to the point at which that support enters the corresponding vertical bore of the tensioner connection hub. Each of the sheaths 135 is also connected at one or more points to the lower surface 154 of the membrane 150. It should be appreciated that the sheaths attach to the tensioner connection hub in any suitable manner, such as via glue or staples, and that the sheaths attach to the membrane in any suitable manner, such as via sewing. In this illustrated embodiment, the membrane has a substantially circular shape, though it should be appreciated that the membrane may have any suitable shape, such as a square, rectangular, or triangular shape.

Figure 4:
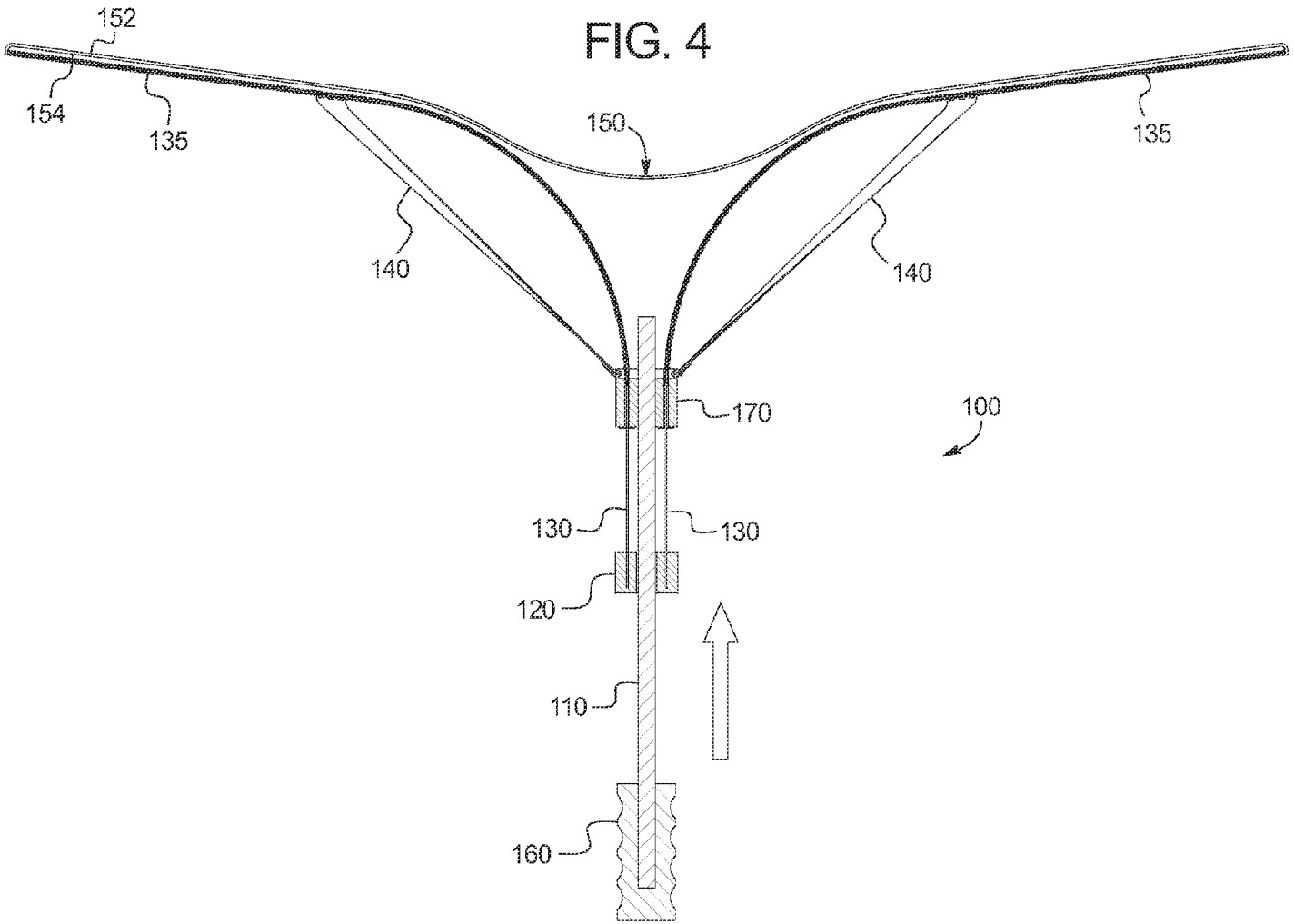
FIG. 4 is a cross-sectional view of the flexible umbrella of FIG. 1 in a half-open or half-unfolded configuration.
Figure 5:
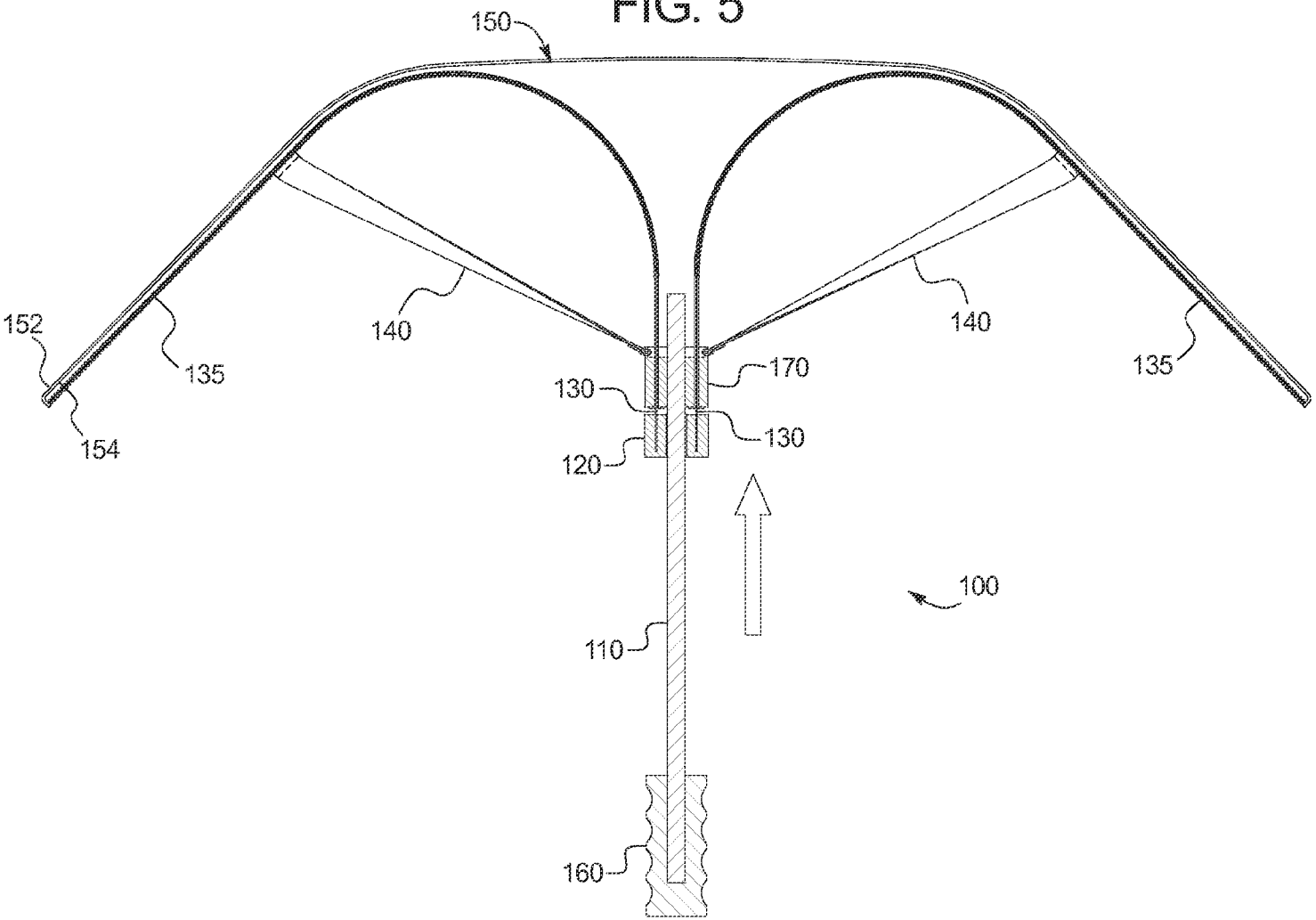
FIG. 5 is a cross-sectional view of the flexible umbrella of FIG. 1 in the unfolded configuration.

The supports are thin, flexible rods that have a normal undeformed shape. More specifically, and as shown in FIGS. 1 and 3, the normal undeformed shape of each support in this embodiment is that of a substantially straight line. When the supports are bent or deformed away from their normal undeformed shapes, as shown in FIGS. 2, 4, and 5, the supports are biased to return to their normal undeformed shapes. It should be appreciated that the supports may be made of any suitable material, such as plastic composite, fiberglass, or aluminum. In this illustrated example, as shown in FIGS. 1 and 2, the flexible umbrella includes six supports and corresponding sheaths, though it should be appreciated that any suitable quantity of supports and corresponding sheaths may be employed. It should also be appreciated that the supports are configured such that when the flexible umbrella is in a closed or folded configuration, as illustrated in FIGS. 1 and 3 (described below), the supports are oriented in relatively the same orientation as the central shaft.

Each of the tensioners 140 is connected at its second, upper end to a different one of the sheaths 135 and at its first, lower end to the tensioner connection hub 170. In this illustrated embodiment, as best shown in FIGS. 1 and 2, each of the sheaths 135 includes a tensioner connection tab (shown in phantom) to which the second, upper end of the respective tensioner 140 is connected. It should be appreciated that the tensioners are connected to the tensioner connection tabs in any suitable manner, such as by sewing, gluing, or stapling. It should also be appreciated that the tensioners may be connected to the sheaths in any other suitable manner other than via a tensioner connection tab. As best shown in FIG. 3A, for each of the tensioners 140, the first, lower end of that tensioner 140 connects to the tensioner connection hub 170 via one of the sets of tensioner receiving slots. Specifically, the first, lower end of that tensioner 140 is fed through the upper tensioner receiving slot of the set from the outside in; is fed back through the corresponding lower tensioner receiving slot of the set; and is then connected to itself, such as by sewing, gluing, or stapling. It should be appreciated that the use of the tensioner receiving slots is one manner in which the tensioners may attach to the tensioner connector hub, and that the tensioners may connect to the tensioner connection hub in any other suitable manner, such as that shown in FIG. 6 (described below).

In this illustrated embodiment, the tensioners are completely flexible and, unlike the supports, do not have a normal undeformed shape. More specifically, in this embodiment, when the tensioners are bent or deformed, the tensioners are not biased to return to any particular shape. In this embodiment, the tensioners are fabric ribbons made of any suitable fabric, though it should be appreciated that the tensioners may be made of any suitably flexible material, such as a plastic composite. In this illustrated embodiment, the connection points of the ends of the tensioners to their corresponding sheaths and to the tensioner connection hub are chosen such that the tensioners are relatively taught when the flexible umbrella is in the folded configuration. In other words, for each tensioner in this embodiment, the distance between the connection point of the first end of that tensioner to the tensioner connector hub and the connection point of the second end of that tensioner to its corresponding sheath is about equal to the length of that tensioner.

Turning to FIGS. 1, 3, and 3A, as noted above, FIG. 1 illustrates a bottom perspective view of the flexible umbrella 100 in the folded configuration, FIG. 3 illustrates a cross-sectional view of the flexible umbrella 100 in the folded configuration, and FIG. 3A illustrates an enlarged cross-sectional view of the flexible umbrella 100 in the folded configuration. When the flexible umbrella 100 is in the folded configuration, the sliding collar 120 is positioned near the first, lower end of the central shaft 110 near the top of the handle 160; the supports 130, corresponding sheaths 135, and tensioners 140 are oriented in relatively the same orientation as the central shaft 110; and the membrane 150 is folded inward such that opposing halves of the upper surface 152 of the membrane 150 face one another. To cause the flexible umbrella 100 to shift from the folded configuration into an open or unfolded configuration, a user applies upward pressure to the sliding collar 120.

Turning to FIG. 4, FIG. 4 illustrates a cross-sectional view of the flexible umbrella 100 in a half-open or half-unfolded configuration. When the user applies upward pressure to the sliding collar 120, the sliding collar 120 and the supports 130

(which are connected to the sliding collar 120) begin moving upward through their respective vertical bores in the tensioner connector hub 170 relative to the central shaft 110; the tensioner connection hub 170; and the first ends of the tensioners 140, which are connected to the tensioner connection hub 170. As the sliding collar 120 and the supports 130 move upward, the tensioners 140 become taught and cause tensile forces to be applied to their corresponding sheaths 135. For each sheath 135 and corresponding tensioner 140, this tensile force originates at the connection point between that sheath 135 and that tensioner 140 (i.e., along the tensioner connection tab), and is applied from that point in a direction along that tensioner 140 toward the connection point between that tensioner 140 and the tensioner connector hub 170. These tensile forces cause the supports 130, which are connected to and covered by the sheaths 135, to bend downward. As the supports 130 bend downward, the connections between the sheaths 135 and the membrane 150 cause the membrane 150 to begin to unfold.

The user moves the sliding collar 120 upward until the sliding collar 120 reaches a designated locking position along the central shaft 110. Once the sliding collar 120 reaches the designated locking position, a locking mechanism (not shown) engages the sliding collar 120 and locks the sliding collar 120 in place relative to the central shaft 110. The sliding collar 120 remains locked in place until the user disengages the sliding collar 120 from the locking mechanism. When the sliding collar 120 reaches the locking position, the flexible umbrella 100 is in the unfolded configuration. FIG. 2 illustrates a bottom perspective view of the flexible umbrella 100 in the unfolded configuration and FIG. 5 illustrates a cross-sectional view of the flexible umbrella 100 in the unfolded configuration.

Figure 6:
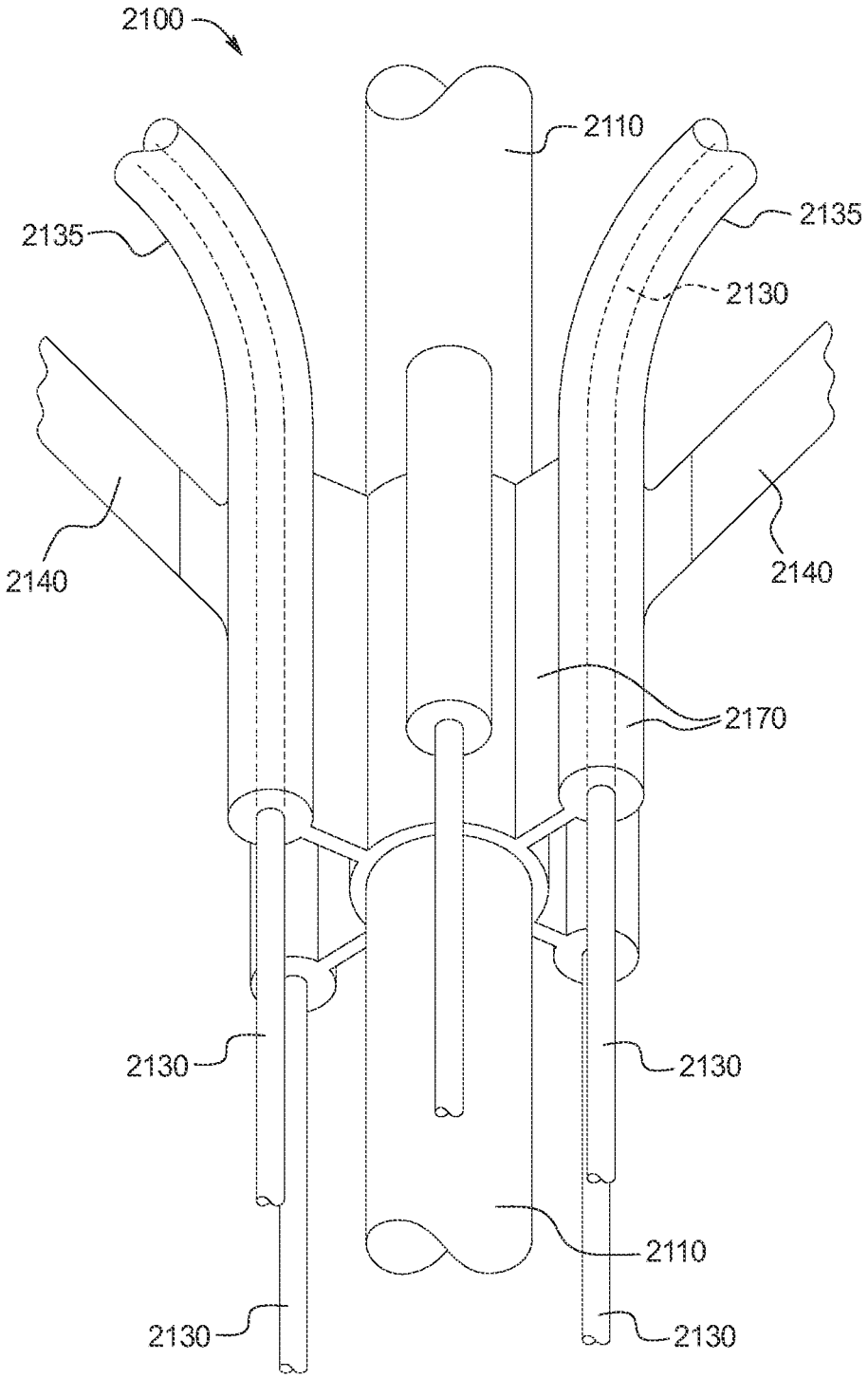
FIG. 6 is an enlarged bottom perspective view of another example embodiment of the flexible umbrella of the present disclosure in which the tensioner connection hub is made of fabric.

FIG. 6 illustrates another example embodiment of the flexible umbrella 2100 in which the tensioner connector hub 2170 is made of fabric or another suitable flexible material. In this embodiment, for each of the sheaths 2135, the first, lower end of that sheath 2135 is connected to the tensioner connector hub 2170 such that that sheath 2135 extends upward from the tensioner connector hub 2170. It should be appreciated that the sheaths attach to the tensioner connection hub in any suitable manner, such as via glue, staples, or sewing. Additionally, in this illustrated embodiment, each of the tensioners 2140 is connected at its first, lower end to one of the sheaths 2135 substantially opposite the connection point of that sheath 2135 to the tensioner connection hub 2170. In this embodiment, the first, lower ends of the tensioners 2140 are sewed to their respective sheaths, though they may be connected in any other suitable manner, such as by glue or staples.

Second Example Embodiment

Turning now to FIGS. 7, 8, 9, 9A, 10, and 11, another example embodiment of the flexible umbrella of the present disclosure is illustrated and generally indicated by numeral 200. In this embodiment, the flexible umbrella 200 includes a hollow central shaft 210 having a first, lower end and a second, upper end including a sliding surface 280; a sliding collar 220 including a plurality of radially spaced sets of tensioner receiving slots (as described above); a plurality of supports 230 each having a first, lower end and a second, upper end; a plurality of sheaths 235 each having a first, lower end and a second, upper end; a plurality of tensioners 240 each having a first end and a second end; a first membrane 250*a* having an upper surface 252*a* and a lower surface 254*a*; a second membrane 250*b* having an upper surface 252*b* and a lower surface 254*b*; and a handle 260.

In this embodiment, the handle 260 is connected to the first, lower end of the central shaft 210 and the sliding collar 220 is slidably connected to and surrounds the central shaft 210 above the handle 260. The central shaft 210 has one or more slits or openings 211 spanning a portion of the length of the central shaft 210 such that the portion of the sliding collar 220 including the tensioner receiving slots is positioned within the hollow portion of the central shaft 210. The second, upper end of the central shaft 210 includes the sliding surface 280 along which the tensioners 240 slide when the flexible umbrella 200 is folded and unfolded (as described below).

Figure 9:
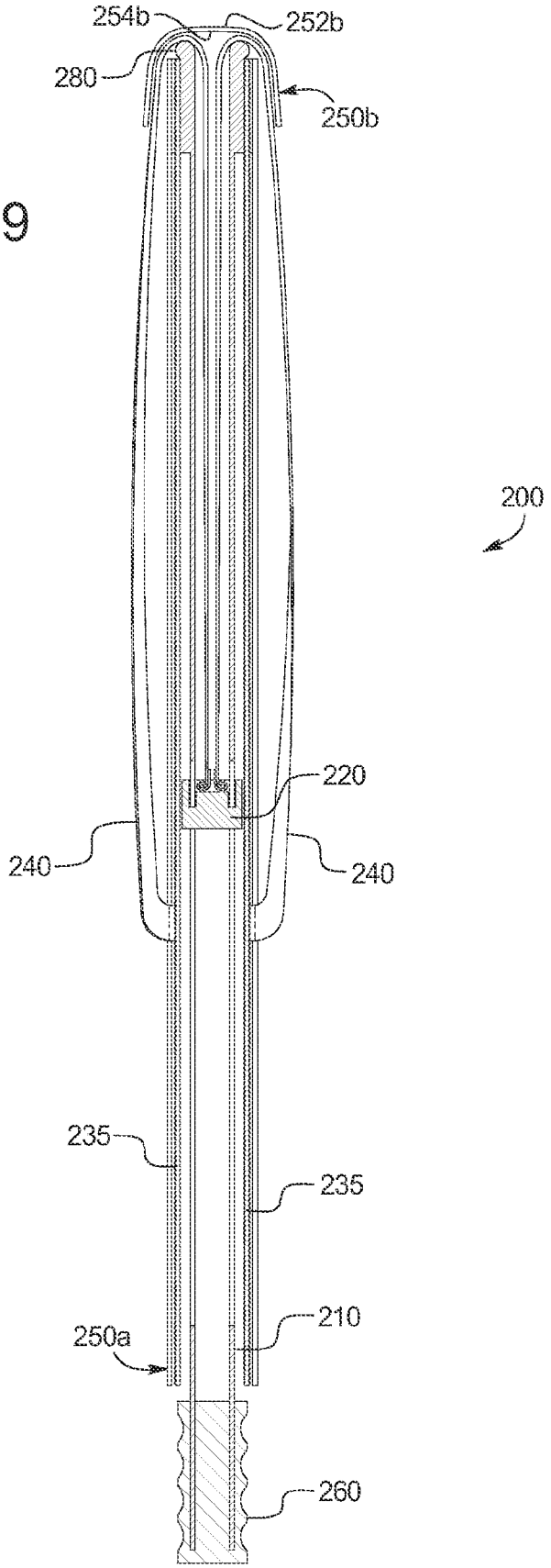
FIG. 9 is a cross-sectional view of the flexible umbrella of FIG. 7 in the folded configuration.
Figure 9A:
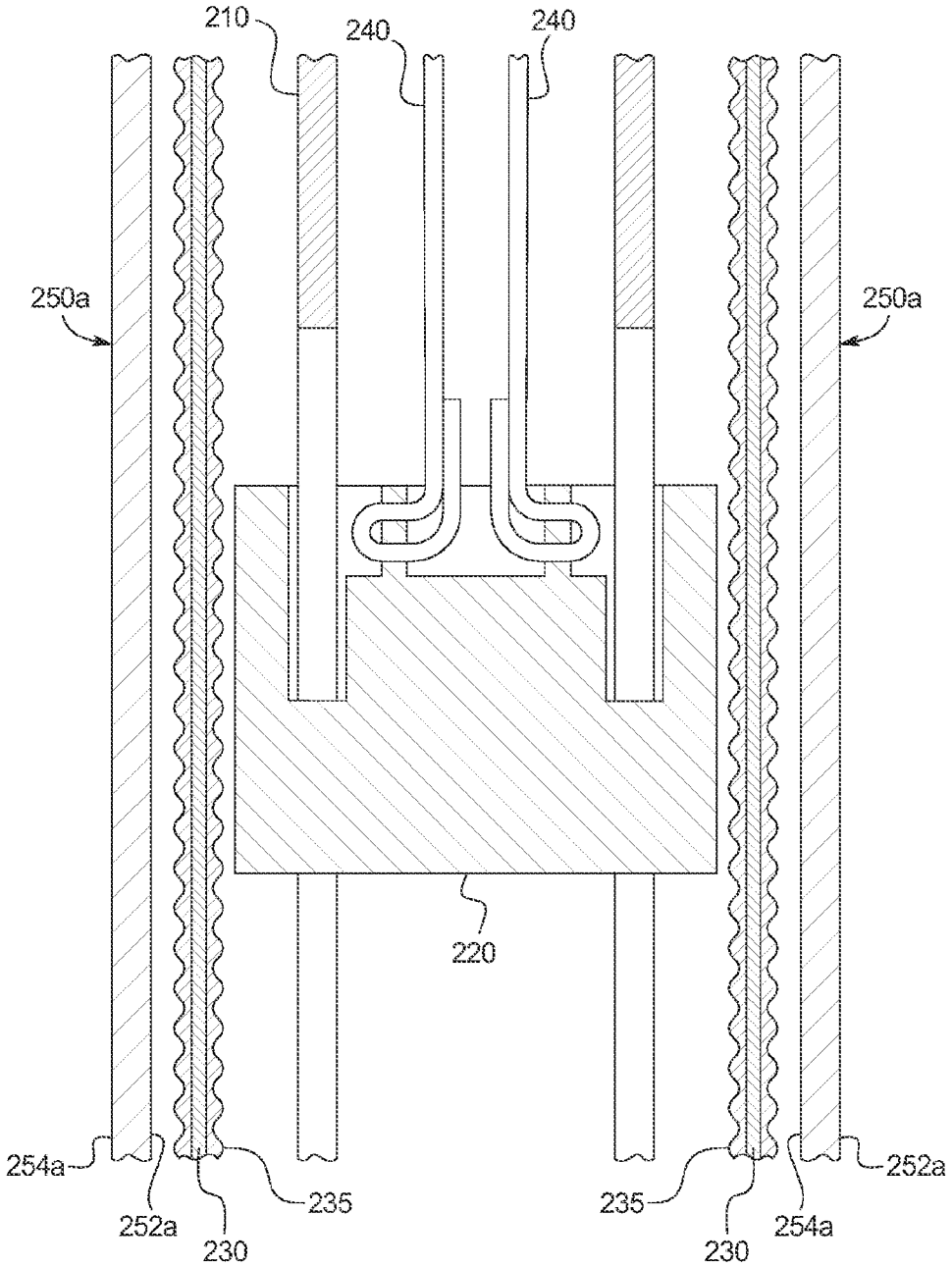
FIG. 9A is an enlarged cross-sectional view of the flexible umbrella of FIG. 7 in the folded configuration.

In this illustrated embodiment, and as best shown in FIG. 9A, each of the supports 230 is covered by a sheath 235, though it should be appreciated that such sheaths are not employed in other embodiments. The second, upper end of each sheath 235 is connected to an exterior surface of the central shaft 210 near the second, upper end of the central shaft 210. Each sheath 235 is also connected at one or more points to the lower surface 254*a* of the first membrane 250*a*, which has a substantially annular shape in this illustrated embodiment. The inner edge of the first membrane 250*a* is connected to the second, upper end of the central shaft 210 near where the second, upper ends of the sheaths 235 are connected to the central shaft 210. The second membrane 250*b*, which has a substantially circular shape in this illustrated embodiment, is positioned such that it covers the upper end of the central shaft 210 and overlaps with the first membrane 250*a*, and such that the tensioners pass between the bottom surface 254*b* of the second membrane 250*b* and the upper surface 252*a* of the first membrane 252*a*. It should be appreciated that the first and second membranes may each have any suitable shape, such as a square, rectangular, or triangular shape.

Each tensioner 240 is connected at its first end to the portion of the sliding collar 220 positioned within the hollow portion of the central shaft 210 via the tensioner receiving slots (as described above) and at its second end to one of the sheaths 235 and/or to the first membrane 250*a*. In certain embodiments, the second ends of the tensioners are connected to the first membrane instead of or in addition to being connected to the sheaths.

Figure 7:
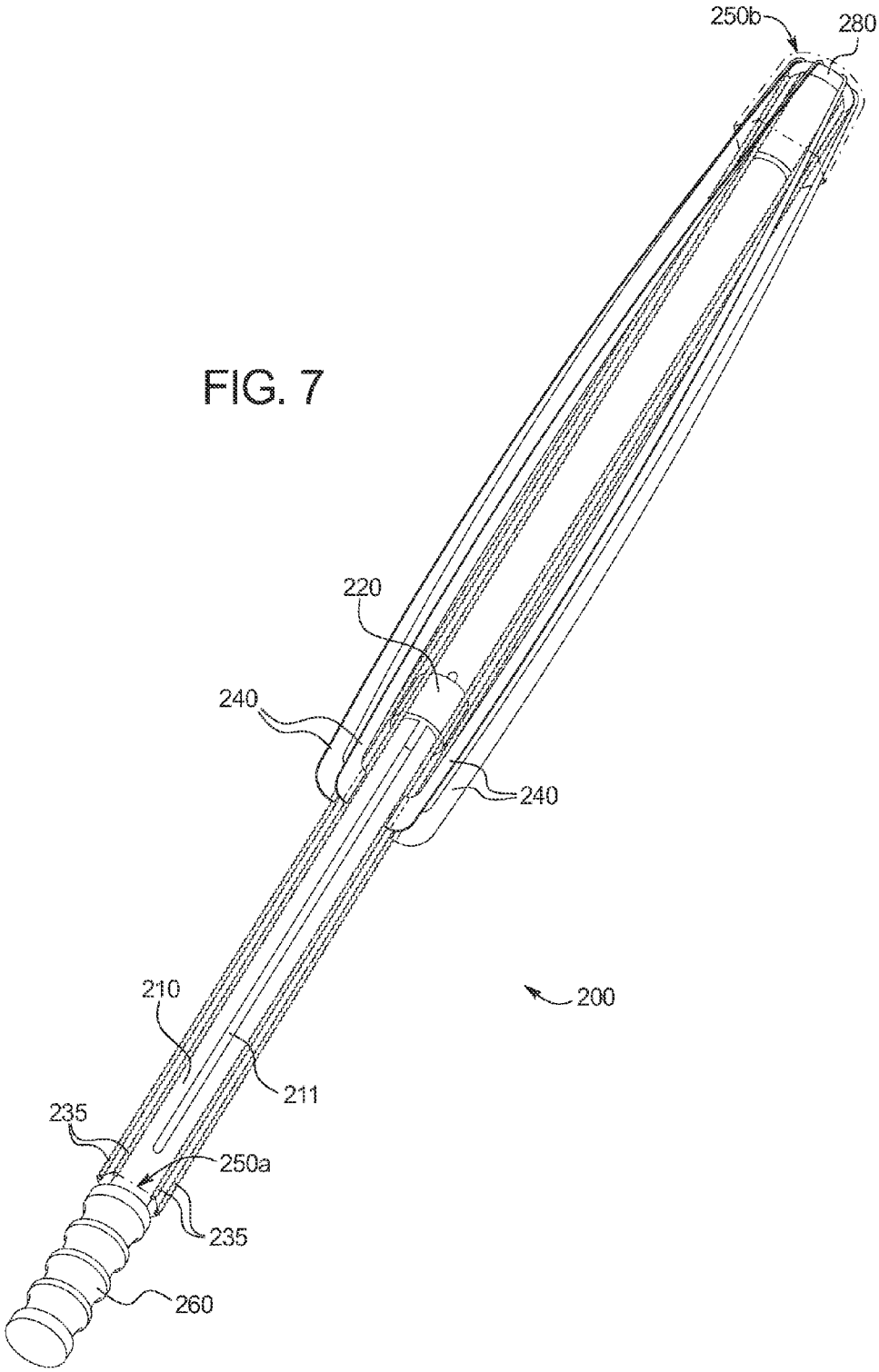
FIG. 7 is a bottom perspective view of another example embodiment of the flexible umbrella of the present disclosure in a closed or folded configuration.

It should be appreciated that the sheaths are connected to the central shaft and to the first membrane such that when the flexible umbrella is in a closed or folded configuration, as illustrated in FIGS. 7 and 9 (described below), the supports are oriented in relatively the same orientation as the central shaft. It should further be appreciated that, in other embodiments, the positions of the sheaths (and the supports within) and the first membrane are switched such that the sheaths are connected to the upper surface of the first membrane. Additionally, in this embodiment, the connection points of the second ends of the tensioners to their corresponding sheaths are chosen such that the tensioners are relatively taught when the flexible umbrella is in the folded configuration.

Turning to FIGS. 7, 9, and 9A, as noted above, FIG. 7 illustrates a bottom perspective view of the flexible umbrella 200 in the folded configuration, FIG. 9 illustrates a cross-sectional view of the flexible umbrella 200 in the folded configuration, and FIG. 9A illustrates an enlarged cross-sectional view of the flexible umbrella 200 in the folded configuration. When the flexible umbrella 200 is in the folded configuration, the sliding collar 220 is positioned near the center of the central shaft 210 and the supports 230 are oriented in relatively the same orientation as the central shaft 210. To cause the flexible umbrella 200 to shift from the folded configuration into an open or unfolded configuration, a user applies downward pressure to the sliding collar 220.

Figure 10:
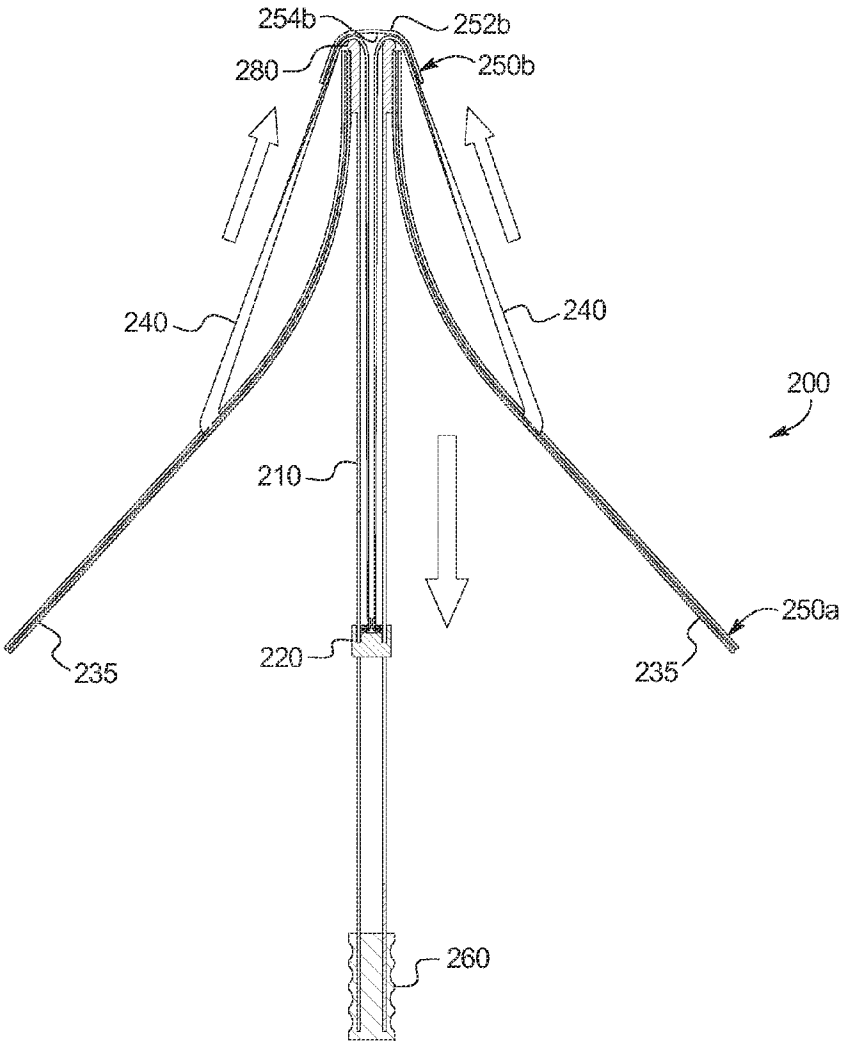
FIG. 10 is a cross-sectional view of the flexible umbrella of FIG. 7 in a half-open or half-unfolded configuration.

Turning to FIG. 10, FIG. 10 illustrates a cross-sectional view of the flexible umbrella 200 in a half-open or half-unfolded configuration. When the user applies downward pressure to the sliding collar 220, the sliding collar 220 and the first ends of the tensioners 240 (which are connected to the sliding collar 220) begin moving downward relative to the central shaft 210 inside the central shaft 210 and the second ends of the tensioners 240 begin moving upward relative to the central shaft 210 outside the central shaft 210. As the sliding collar 220 and the first ends of the tensioners 240 move downward, the tensioners 240 become taught and are pulled across sliding surface 280 into the hollow portion of the central shaft 210. As this is occurring, the tensioners 240 cause tensile forces to be applied to their corresponding sheaths 235. For each tensioner 240 and corresponding sheath 235, this tensile force originates at the connection point between that tensioner 240 and that sheath 235 (such as along the tensioner connection tab described above), and is applied from that point in a direction along that tensioner 240 toward the point at which that tensioner 240 slides along the sliding surface 280. These tensile forces cause the supports 230 to bend upward, away from the central shaft 210. As the supports 230 bend upward, the connections between the sheaths 235 and the first membrane 250 cause the first membrane 250 to similarly bend upward.

Figure 8:
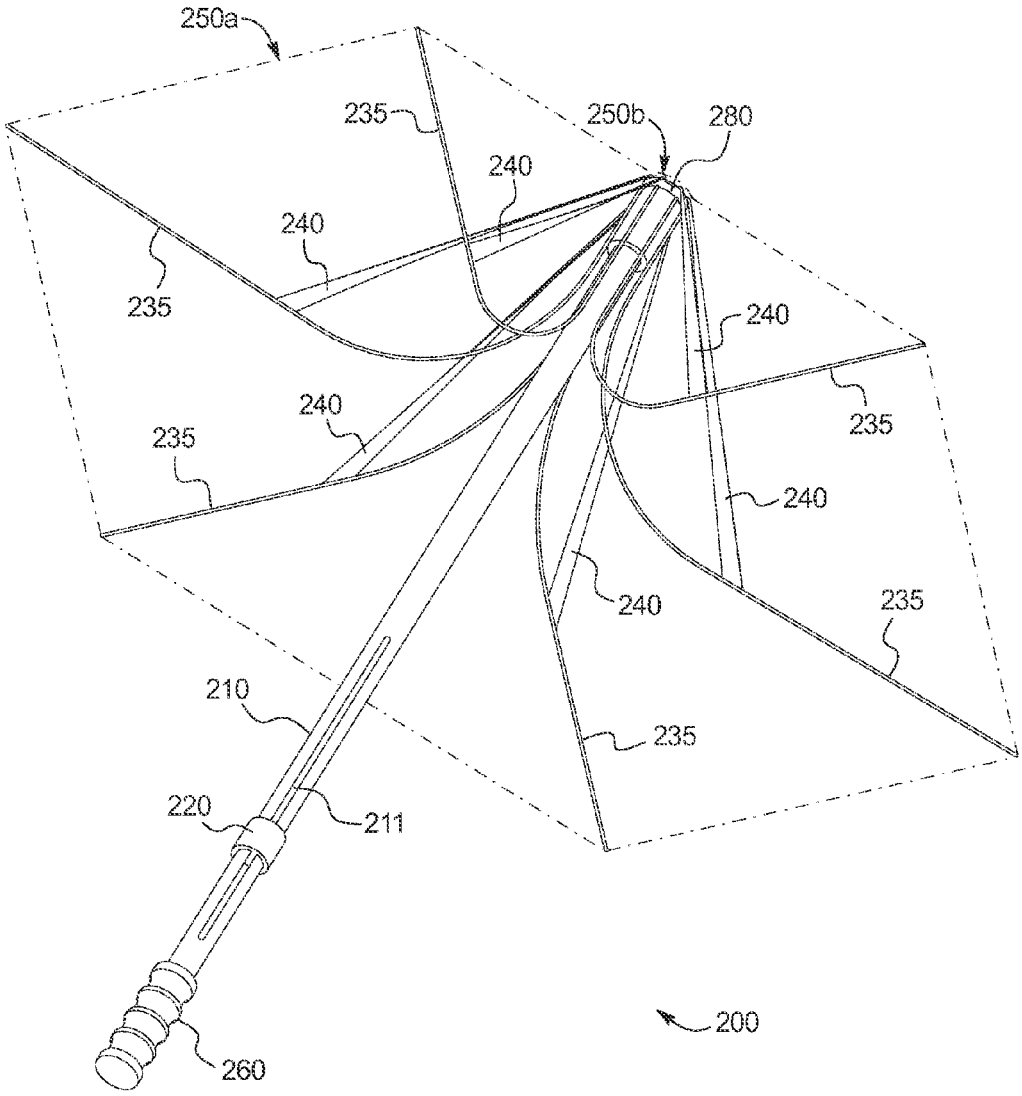
FIG. 8 is a bottom perspective view of the embodiment of the flexible umbrella of FIG. 7 in an open or unfolded configuration.
Figure 11:
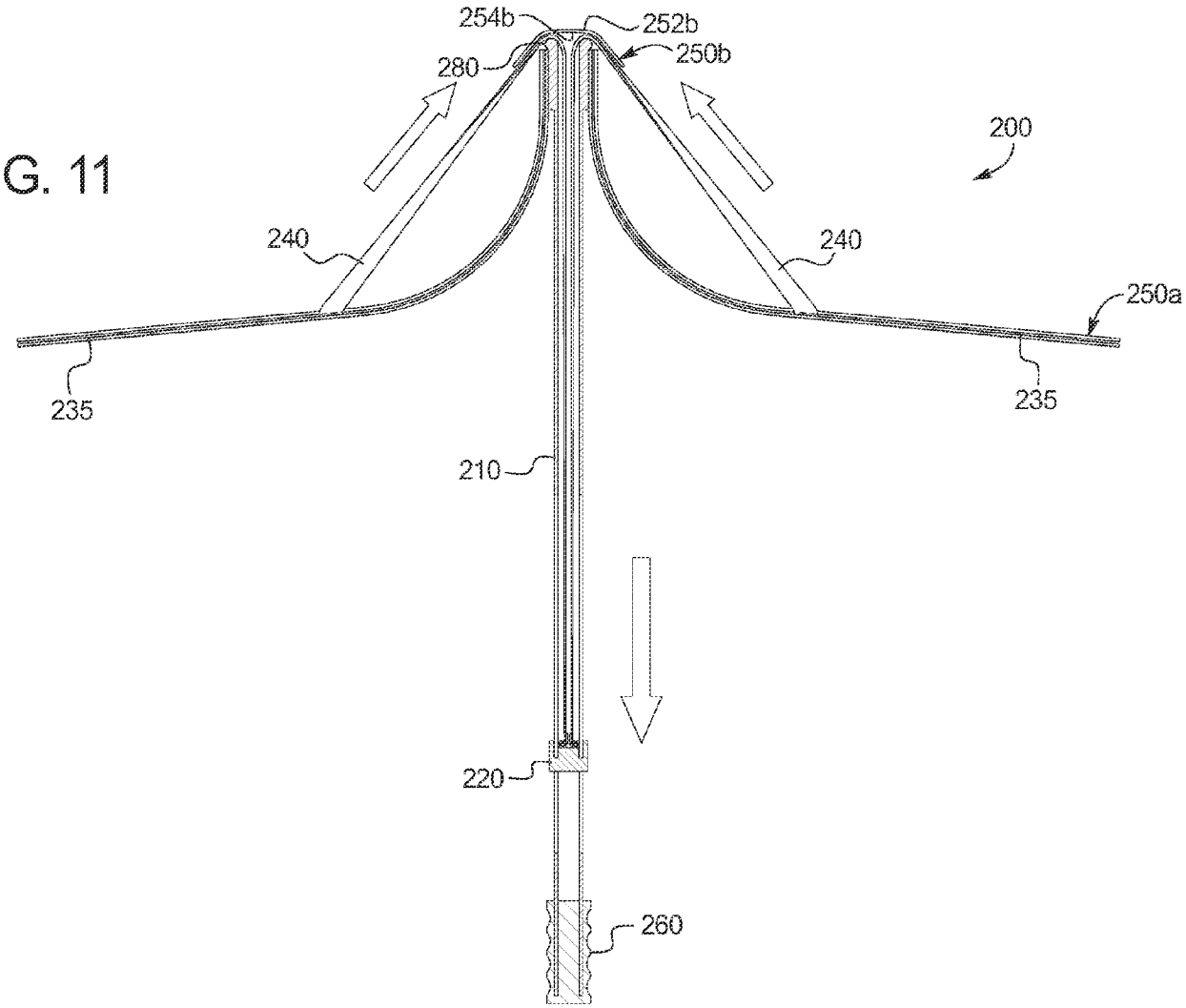
FIG. 11 is a cross-sectional view of the flexible umbrella of FIG. 7 in the unfolded configuration.

The user moves the sliding collar 220 downward until the sliding collar 220 reaches a designated locking position along the central shaft 210. Once the sliding collar 220 reaches the designated locking position, a locking mechanism (not shown) engages the sliding collar 220 and locks the sliding collar 220 in place relative to the central shaft 210. The sliding collar 220 remains locked in place until the user disengages the sliding collar 220 from the locking mechanism. When the sliding collar 220 reaches the locking position, the flexible umbrella 200 is in the unfolded configuration. FIG. 8 illustrates a bottom perspective view of the flexible umbrella 200 in the unfolded configuration and FIG. 11 illustrates a cross-sectional view of the flexible umbrella 200 in the unfolded configuration.

Third Example Embodiment

Turning now to FIGS. 12, 13, 14, 14A, 15, and 16, another example embodiment of the flexible umbrella of the present disclosure is illustrated and generally indicated by numeral 300. In this example embodiment, the flexible umbrella 300 includes a central shaft 310 having a first, lower end and a second, upper end; a sheath securing hub 390; a sliding collar 320 including a plurality of radially spaced sets of tensioner receiving slots (as described above); a plurality of supports 330 each having a first, lower end and a second, upper end; a plurality of sheaths 335 each having a first, lower end and a second, upper end; a plurality of tensioners 340 each having a first, lower end and a second, upper end; a membrane 350 having an upper surface 352 and a lower surface 354; a handle 360; and a restrainer 380.

In this embodiment, the handle 360 is connected to the first, lower end of the central shaft 310; the sheath securing hub 390 is connected to and surrounds the central shaft 310 near the second, upper end of the central shaft 310; and the sliding collar 320 is slidably connected to and surrounds the central shaft 310 between the handle 360 and the sheath securing hub 390. In this illustrated embodiment, as best shown in FIG. 14A, each support 330 is covered by one of the sheaths 335, though it should be appreciated that such sheaths are not employed in other embodiments. The first, lower end of each of the sheaths 335 is connected to the sheath securing hub 390 (such as via glue, sewing, or staples), and the second, upper end of each of the sheaths 335 is connected to the lower surface 354 of the membrane 350 at one or more points. Each tensioner 340 is connected at its first, lower end to the sliding collar 320 via the tensioner receiving slots (as described above) and at its second, upper end to one of the sheaths 335. The restrainer 380 is fixed to the central shaft 310 at a designated position along the central shaft 310. That is, in this illustrated embodiment, the restrainer 380 is not configured to slide relative to the central shaft 310. The restrainer 380 surrounds the central shaft 310, the sheaths 335 and supports 330 within, and the tensioners 340. In this illustrated embodiment, the membrane has a substantially circular shape, though it should be appreciated that the membrane may have any suitable shape, such as a square, rectangular, or triangular shape.

Figure 12:
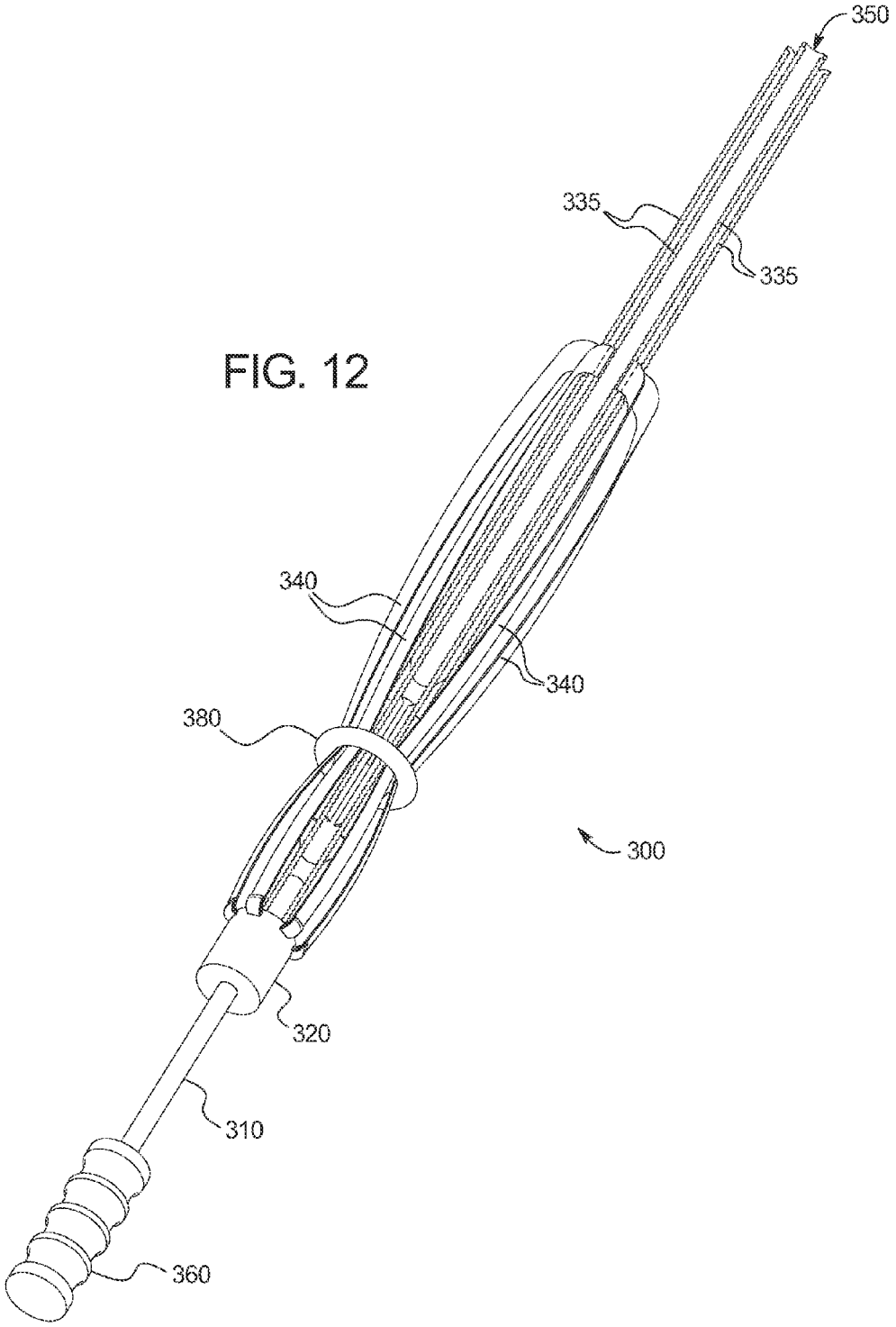
FIG. 12 is a bottom perspective view of another example embodiment of the flexible umbrella of the present disclosure in a dosed or folded configuration.
Figure 14:
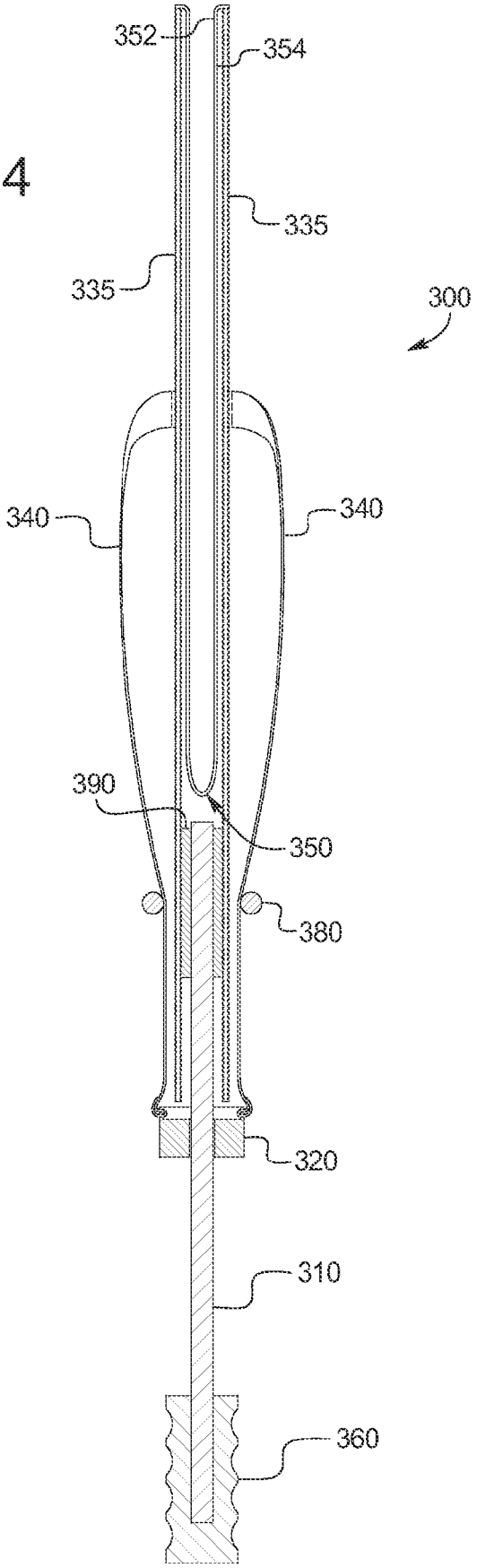
FIG. 14 is a cross-sectional view of the flexible umbrella of FIG. 12 in the folded configuration.
Figure 14A:
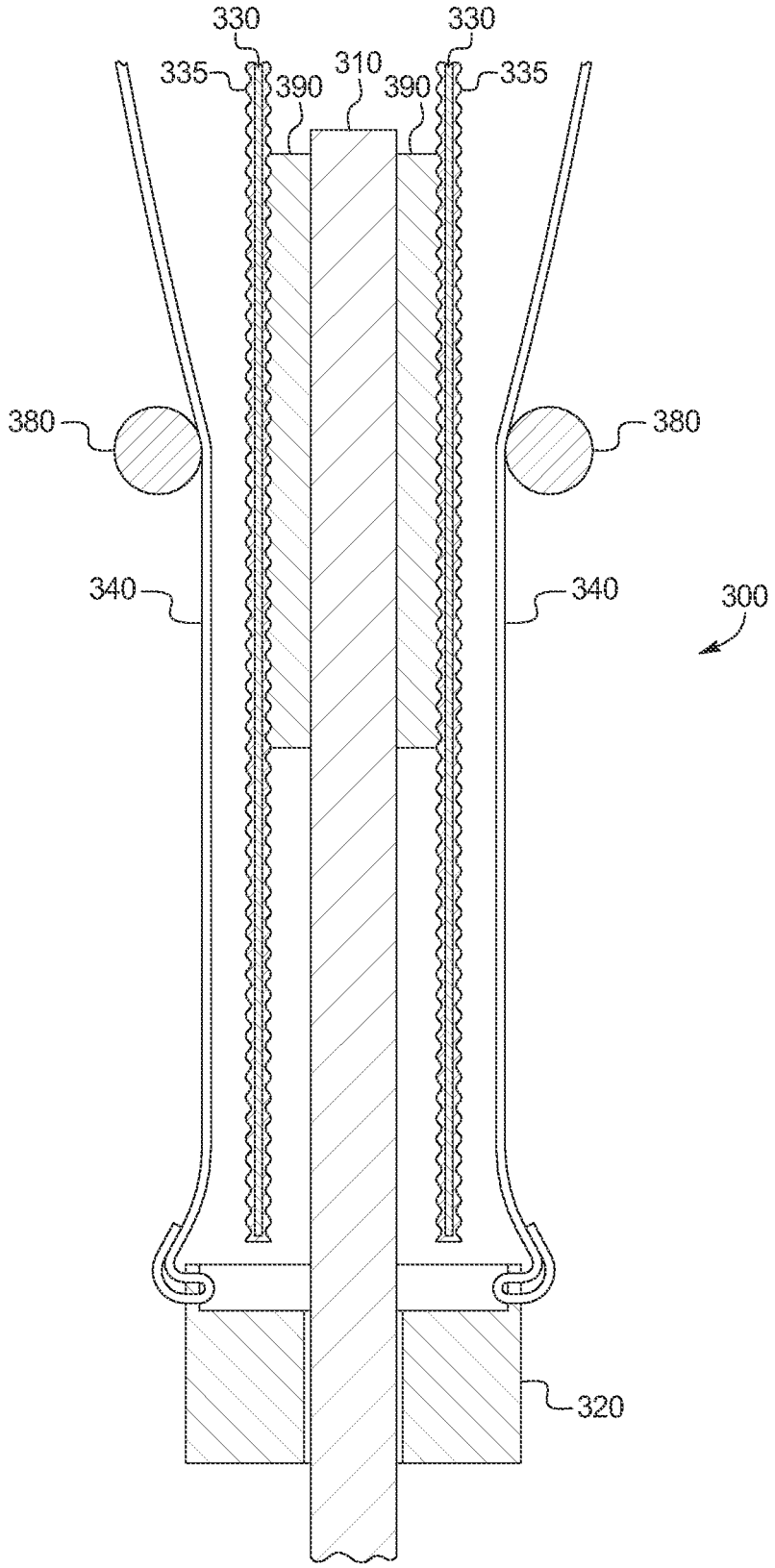
FIG. 14A is an enlarged cross-sectional view of the flexible umbrella of FIG. 12 in the folded configuration.

It should be appreciated that the sheaths are connected to the sheath securing hub and the membrane such that when the flexible umbrella is in a dosed or folded configuration, as illustrated in FIGS. 12 and 14 (described below), the supports are oriented in relatively the same orientation as the central shaft. Further, in this illustrated embodiment, the connection points of the second, upper ends of the tensioners to their corresponding sheaths are chosen such that the tensioners are relatively taught when the flexible umbrella is in the folded configuration. In other words, for each tensioner in this embodiment, the distance between the connection point of the first, lower end of that tensioner to the sliding collar and the connection point of the second, upper end of that tensioner to its corresponding support is about equal to the length of that tensioner.

Turning to FIGS. 12, 14, and 14A, as noted above, FIG. 12 illustrates a bottom perspective view of the flexible umbrella 300 in the folded configuration, FIG. 14 illustrates a cross-sectional view of the flexible umbrella 300 in the folded configuration, and FIG. 14A illustrates an enlarged cross-sectional view of the flexible umbrella 300 in the folded configuration. When the flexible umbrella 300 is in the folded configuration, the sliding collar 320 is positioned near the center of the central shaft 310; the sheaths 335 and supports 330 within and the tensioners 340 are oriented in relatively the same orientation as the central shaft 310; and the membrane 350 is folded inward such that opposing halves of upper surface 352 of the membrane 350 face one another. To cause the flexible umbrella 300 to shift from the folded configuration into an open or unfolded configuration, a user applies downward pressure to the sliding collar 320.

Figure 15:
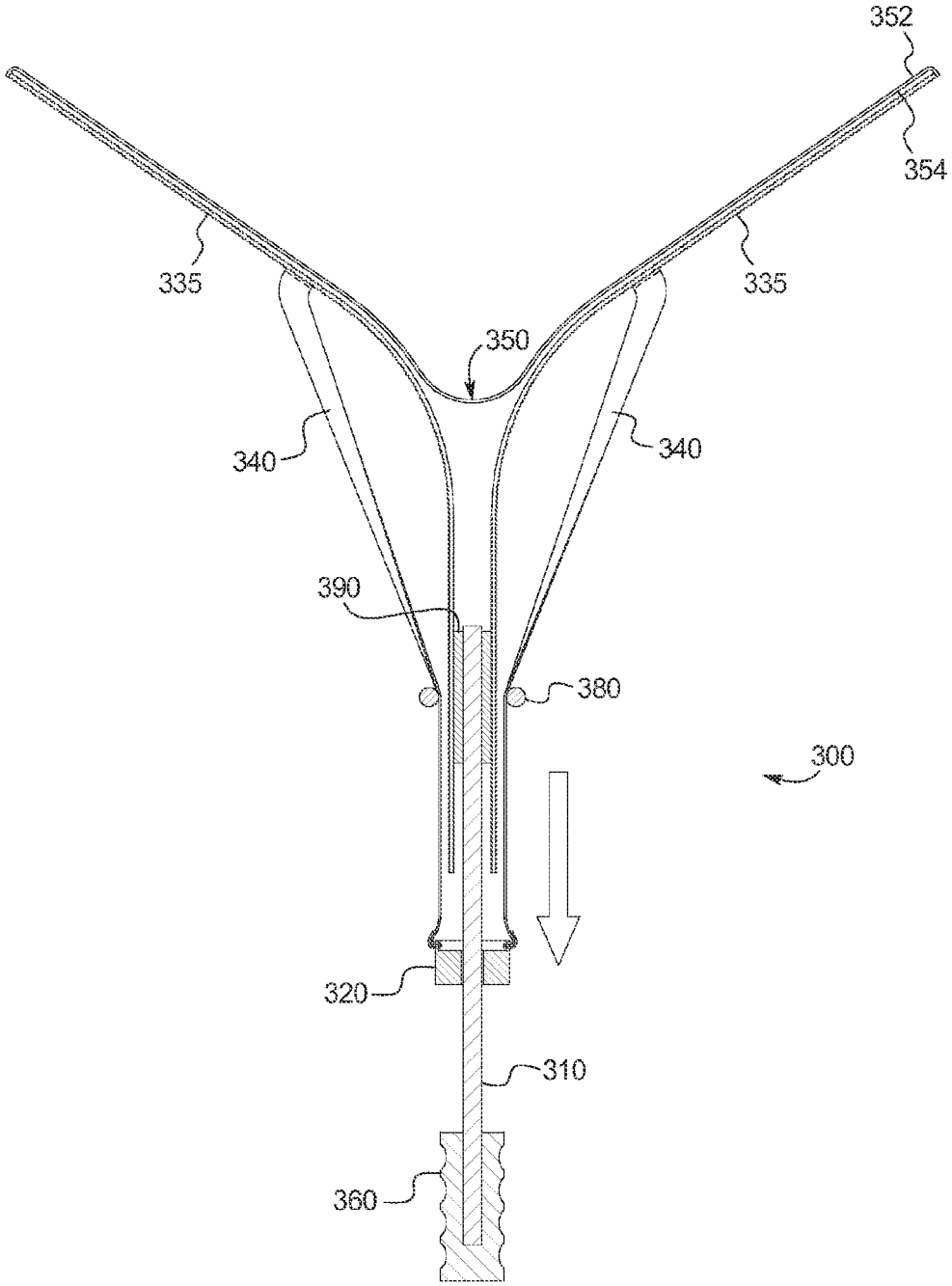
FIG. 15 is a cross-sectional view of the flexible umbrella of FIG. 12 in a half-open or half-unfolded configuration.

Turning to FIG. 15, FIG. 15 illustrates a cross-sectional view of the flexible umbrella 300 in a half-open or half-unfolded configuration. When the user applies downward pressure to the sliding collar 320, the sliding collar 320 and the tensioners 340 (which are connected to the sliding collar 320) begin moving downward relative to the central shaft 310. As the sliding collar 320 and the tensioners 340 move downward, the tensioners 340 become taught and cause tensile forces to be applied to their corresponding sheaths 335. For each sheath 335 and corresponding tensioner 340, this tensile force originates at the connection point between that sheath 335 and that tensioner 340, and is applied from that point in a direction along that tensioner 340 toward the point at which that tensioner contacts the restrainer 380. These tensile forces cause the supports 330 to bend downward. As the supports 330 bend downward, the connections between the supports 330 and the membrane 350 cause the membrane 350 to begin to unfold.

Figure 13:
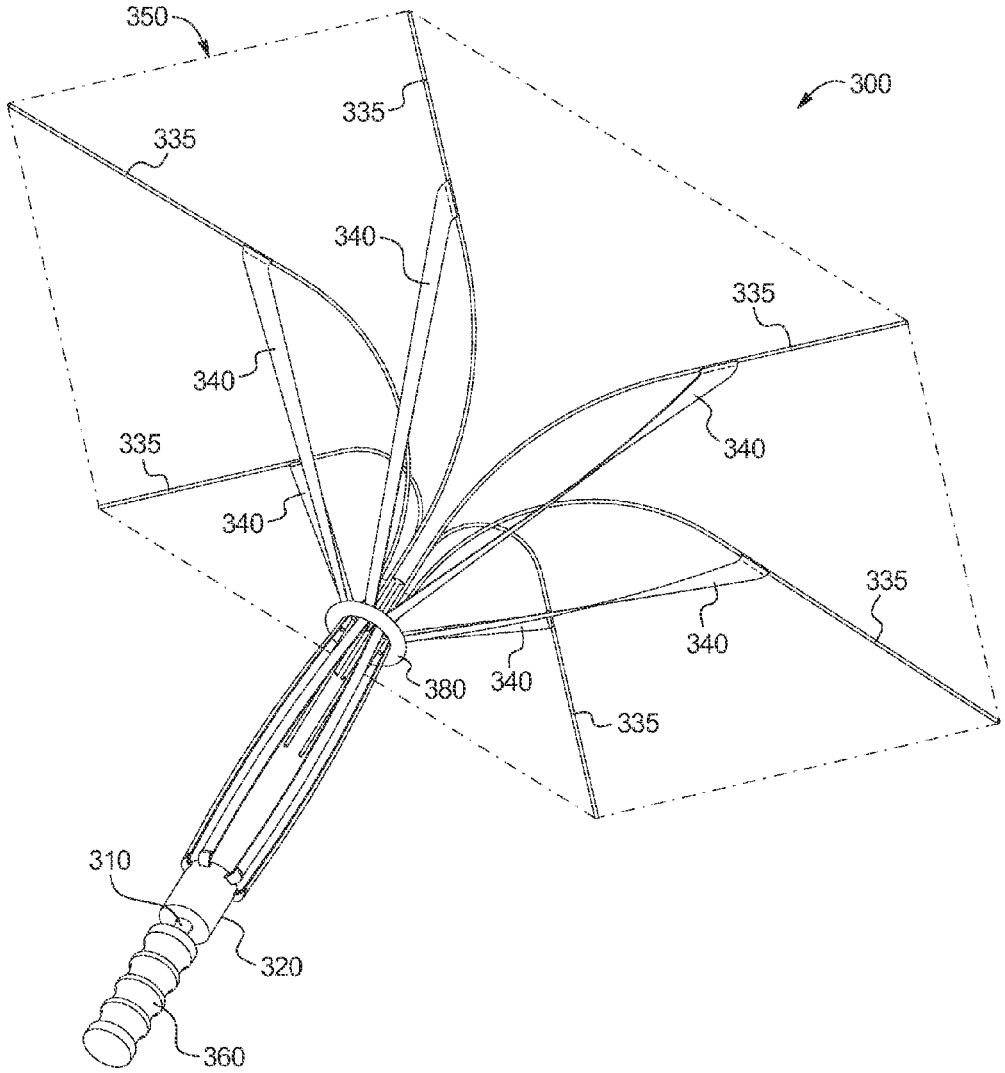
FIG. 13 is a bottom perspective view of the embodiment of the flexible umbrella of FIG. 12 in an open or unfolded configuration.
Figure 16:
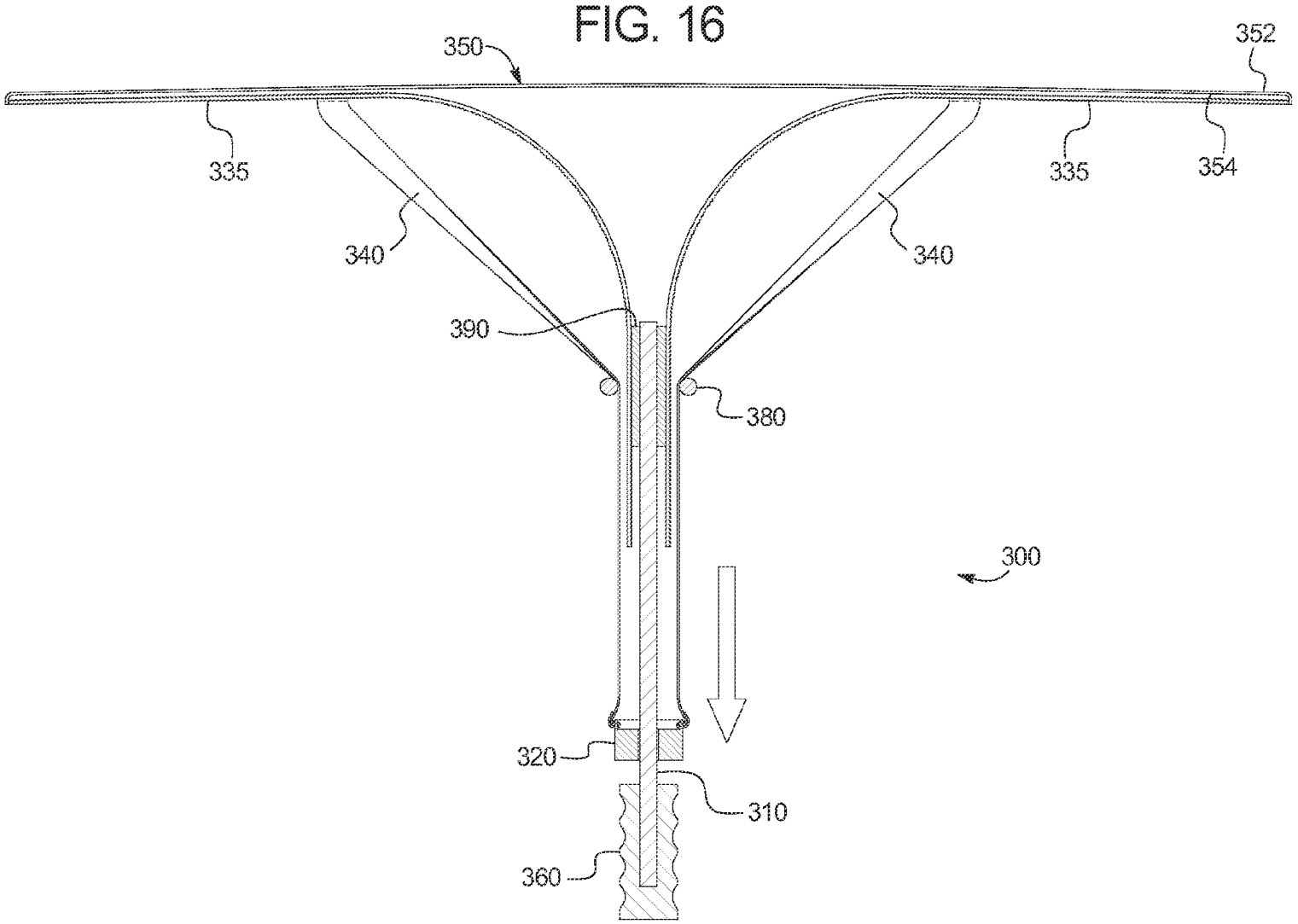
FIG. 16 is a cross-sectional view of the flexible umbrella of FIG. 12 in the unfolded configuration.

The user moves the sliding collar 320 downward until the sliding collar 320 reaches a designated locking position along the central shaft 310. Once the sliding collar 320 reaches the designated locking position, a locking mechanism (not shown) engages the sliding collar 320 and locks the sliding collar 320 in place relative to the central shaft 310. The sliding collar 320 remains locked in place until the user disengages the sliding collar 320 from the locking mechanism. When the sliding collar 320 reaches the locking position, the flexible umbrella 300 is in the unfolded configuration. FIG. 13 illustrates a bottom perspective view of the flexible umbrella in the unfolded configuration and FIG. 16 illustrates a cross-sectional view of the flexible umbrella 200 in the unfolded configuration.

Figure 16A:
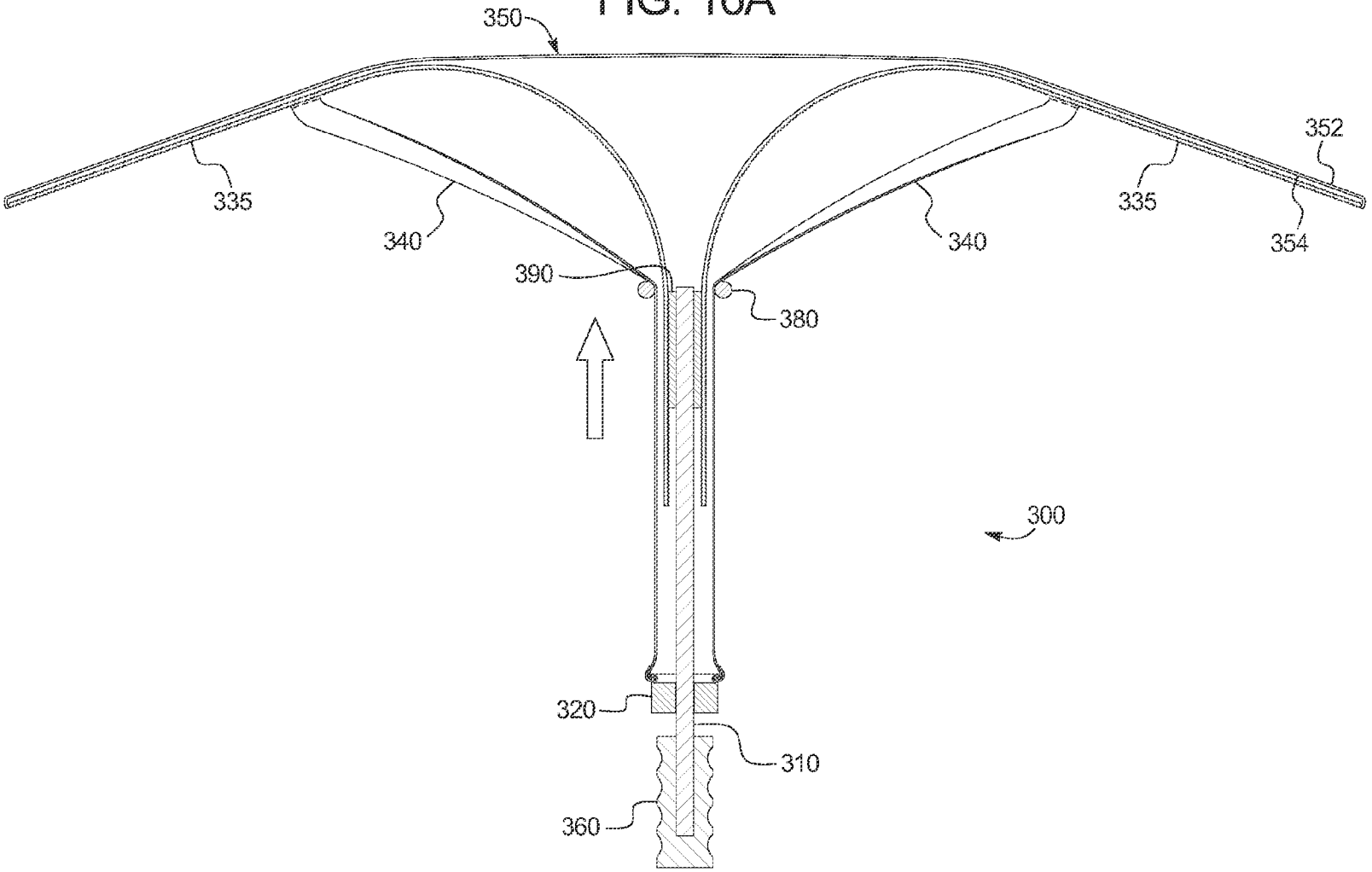
FIG. 16A is a cross-sectional view of another example embodiment of the flexible umbrella including a slidable restrainer.
Figure 17:
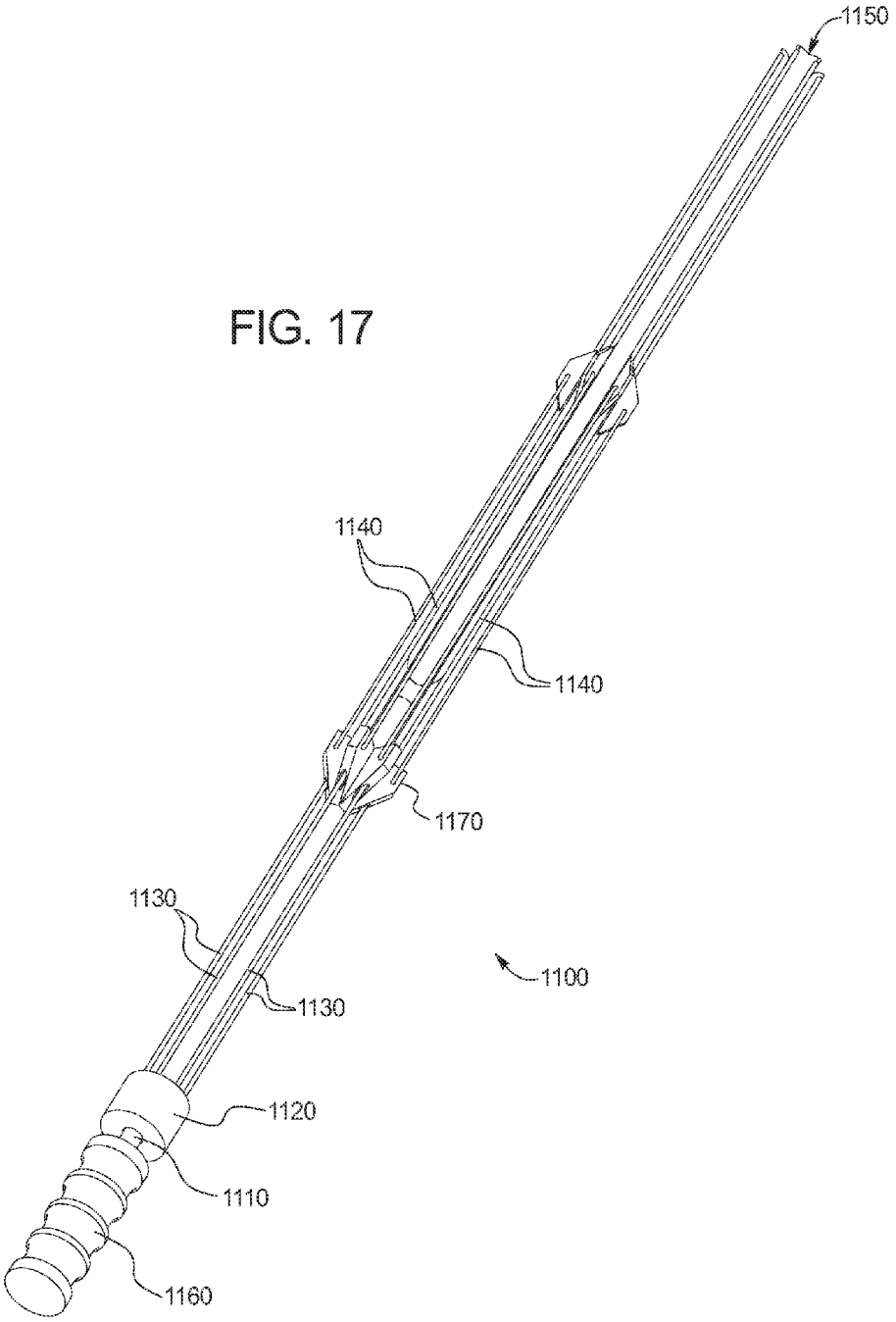
FIG. 17 is a bottom perspective view of another example embodiment of the flexible umbrella of the present disclosure in a dosed or folded configuration.
Figure 18:
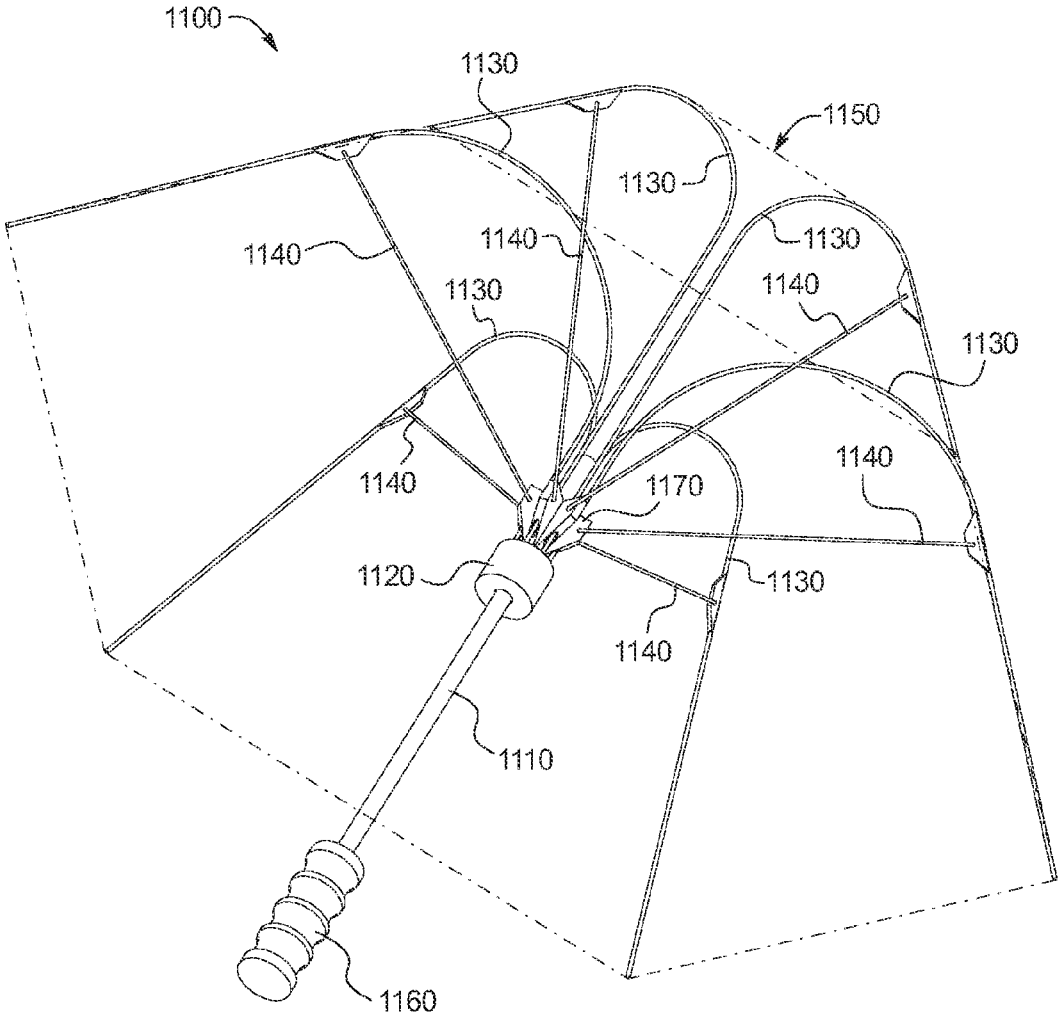
FIG. 18 is a bottom perspective view of the embodiment of the flexible umbrella of FIG. 17 in an open or unfolded configuration.
Figure 19:
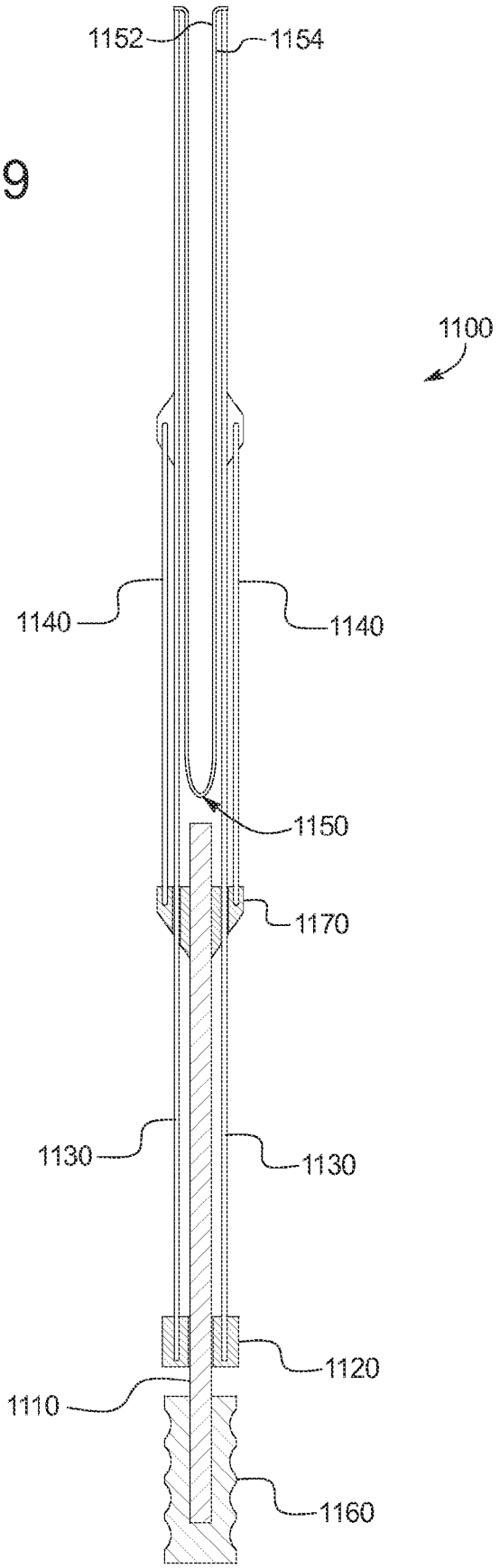
FIG. 19 is a cross-sectional view of the flexible umbrella of FIG. 17 in the folded configuration.
Figure 20:
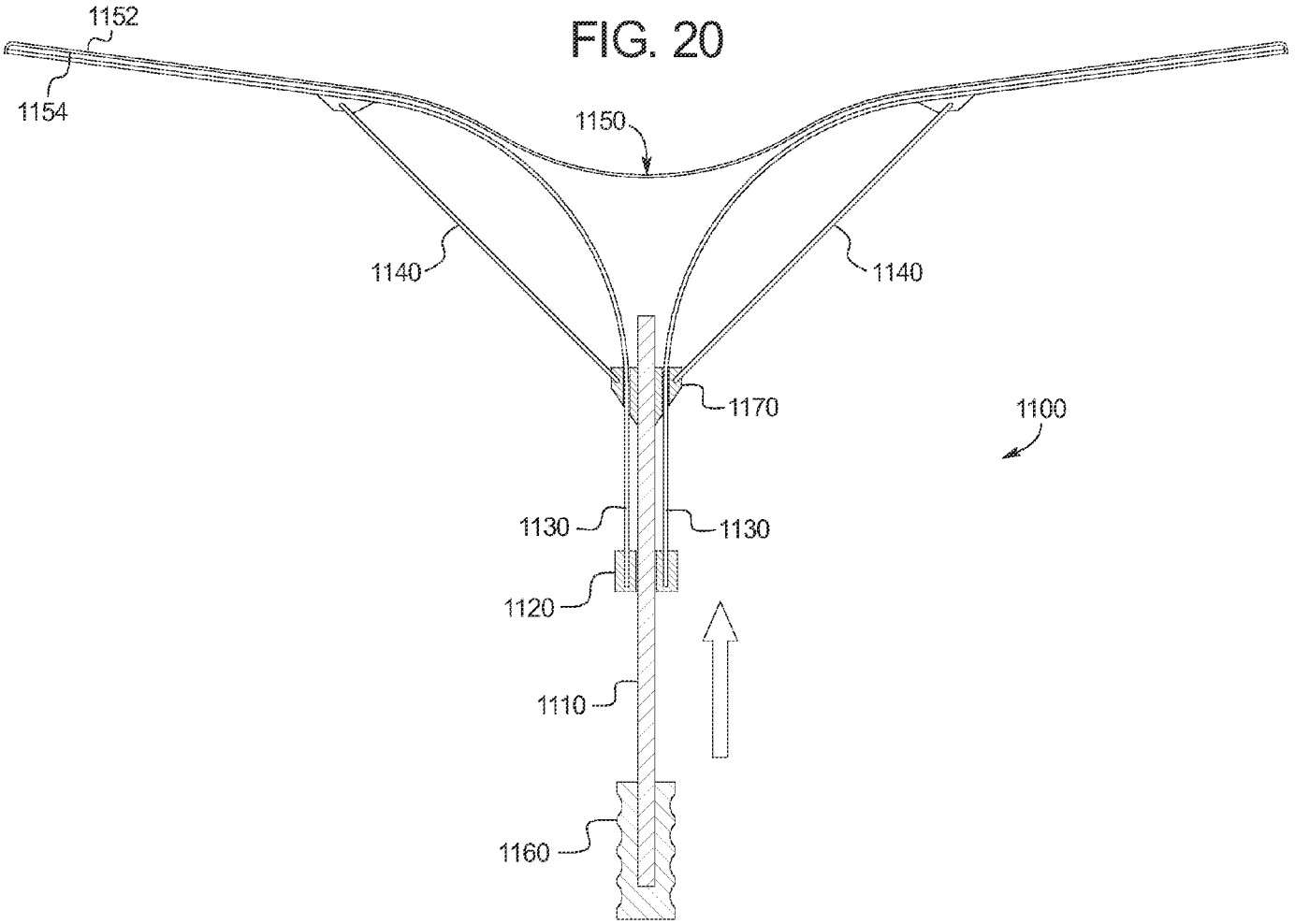
FIG. 20 is a cross-sectional view of the flexible umbrella of FIG. 17 in a half-open or half-unfolded configuration.
Figure 21:
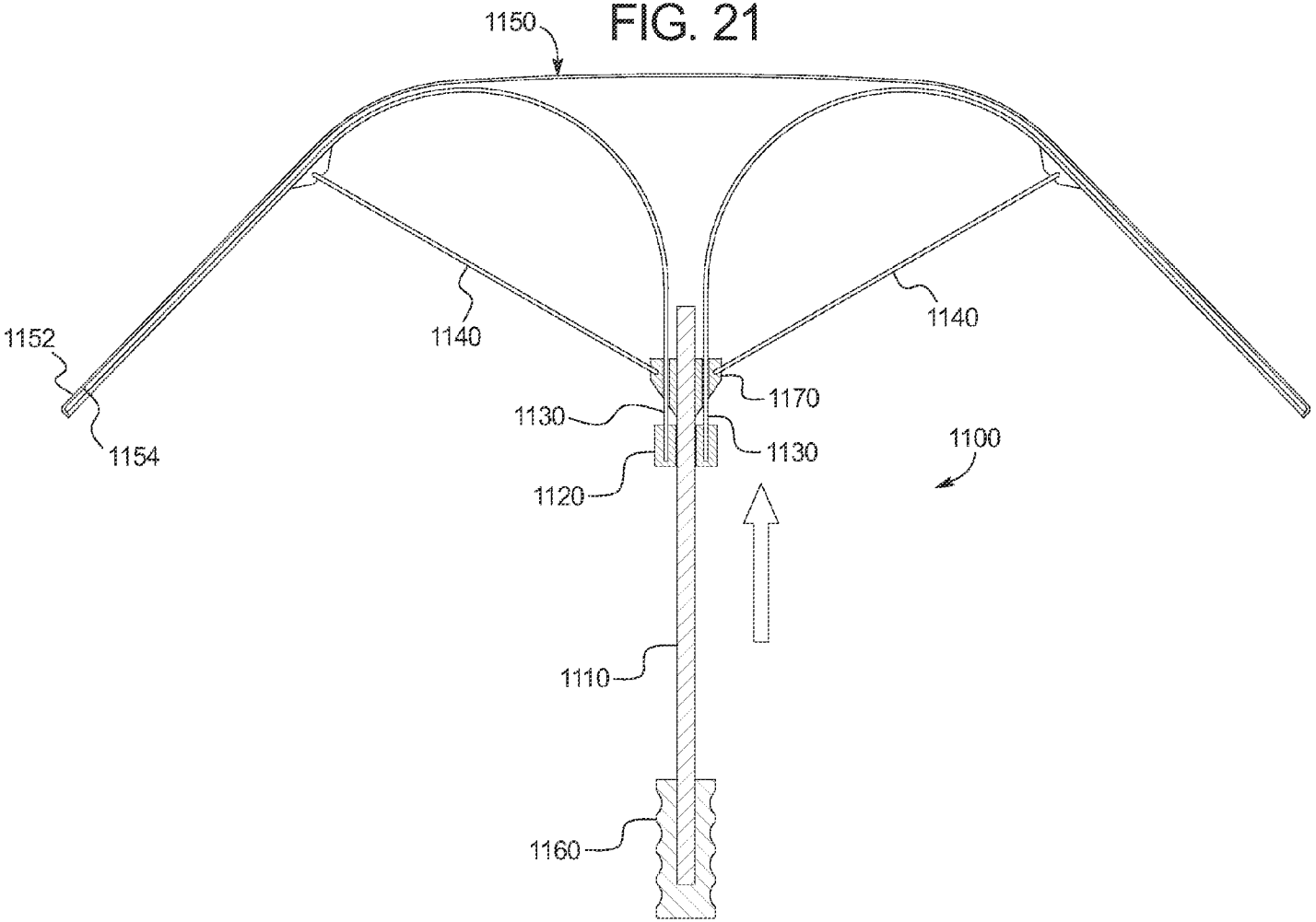
FIG. 21 is a cross-sectional view of the flexible umbrella of FIG. 17 in the unfolded configuration.
Figure 22:
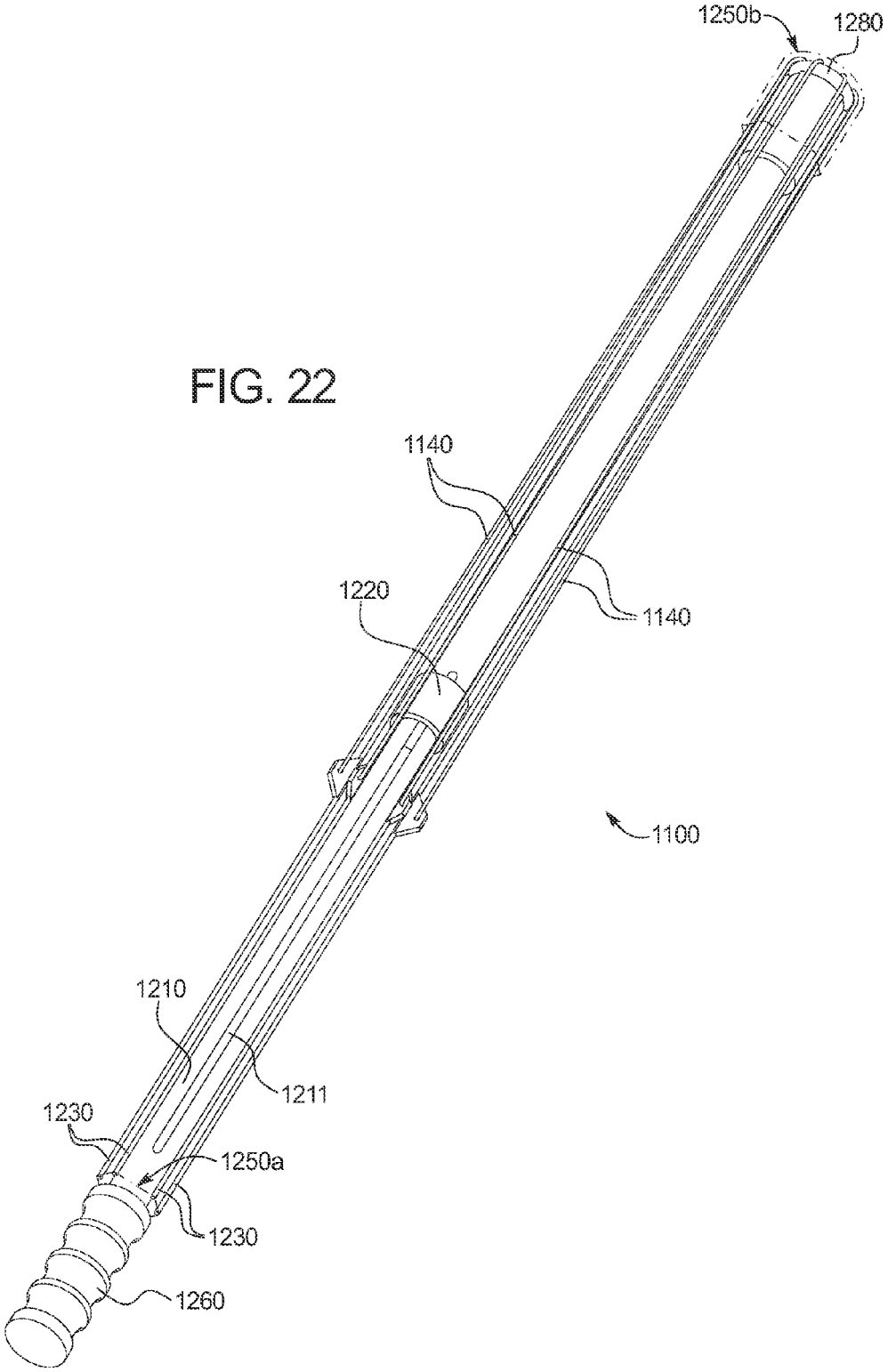
FIG. 22 is a bottom perspective view of another example embodiment of the flexible umbrella of the present disclosure in a dosed or folded configuration.
Figure 23:
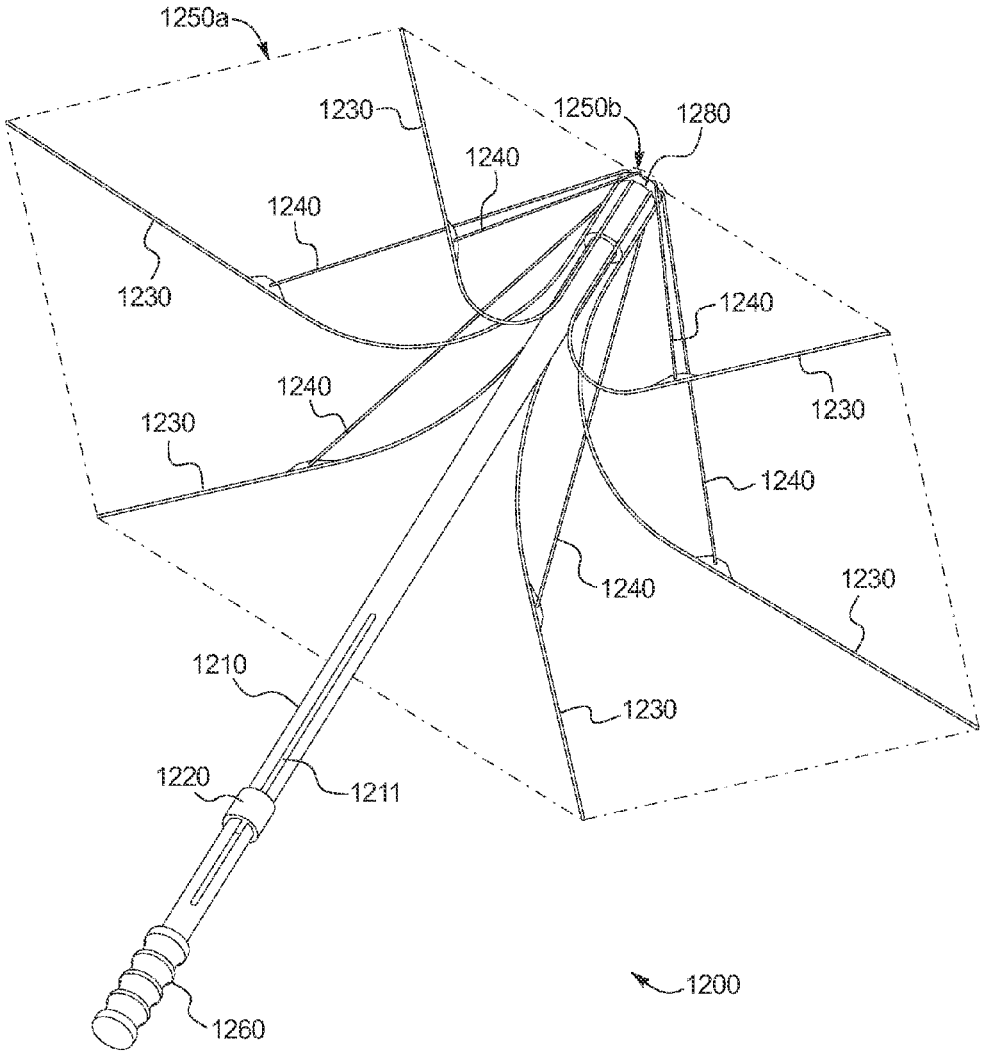
FIG. 23 is a bottom perspective view of the embodiment of the flexible umbrella of FIG. 22 in an open or unfolded configuration.
Figure 24:
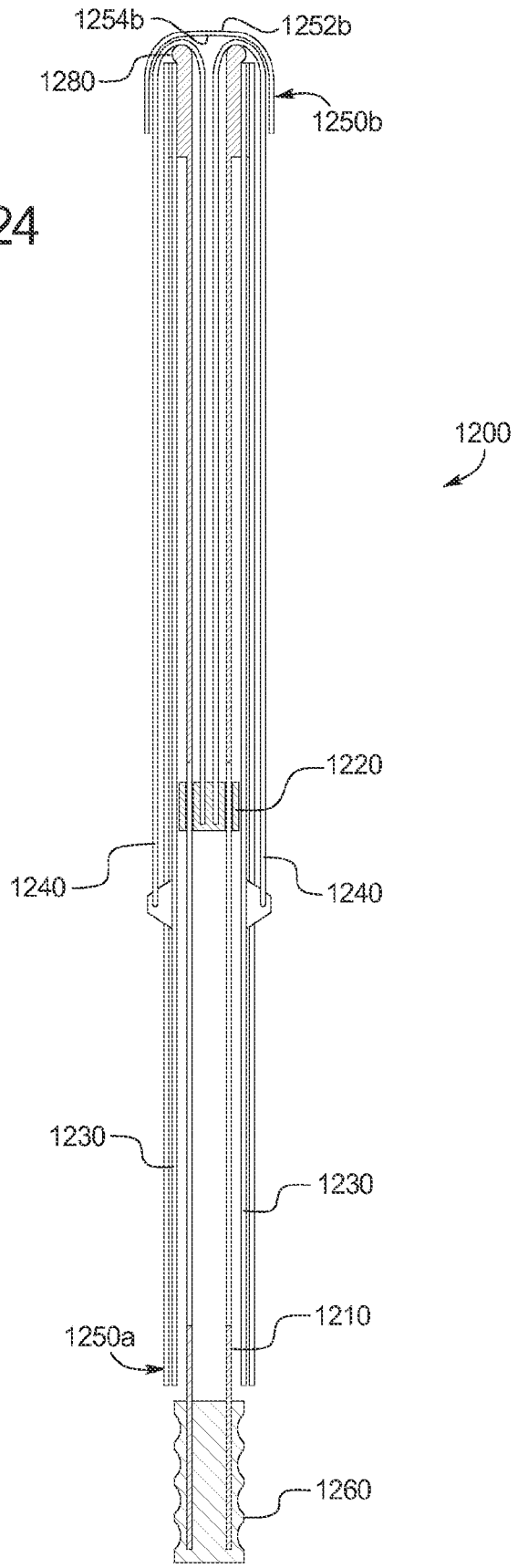
FIG. 24 is a cross-sectional view of the flexible umbrella of FIG. 22 in the folded configuration.
Figure 25:
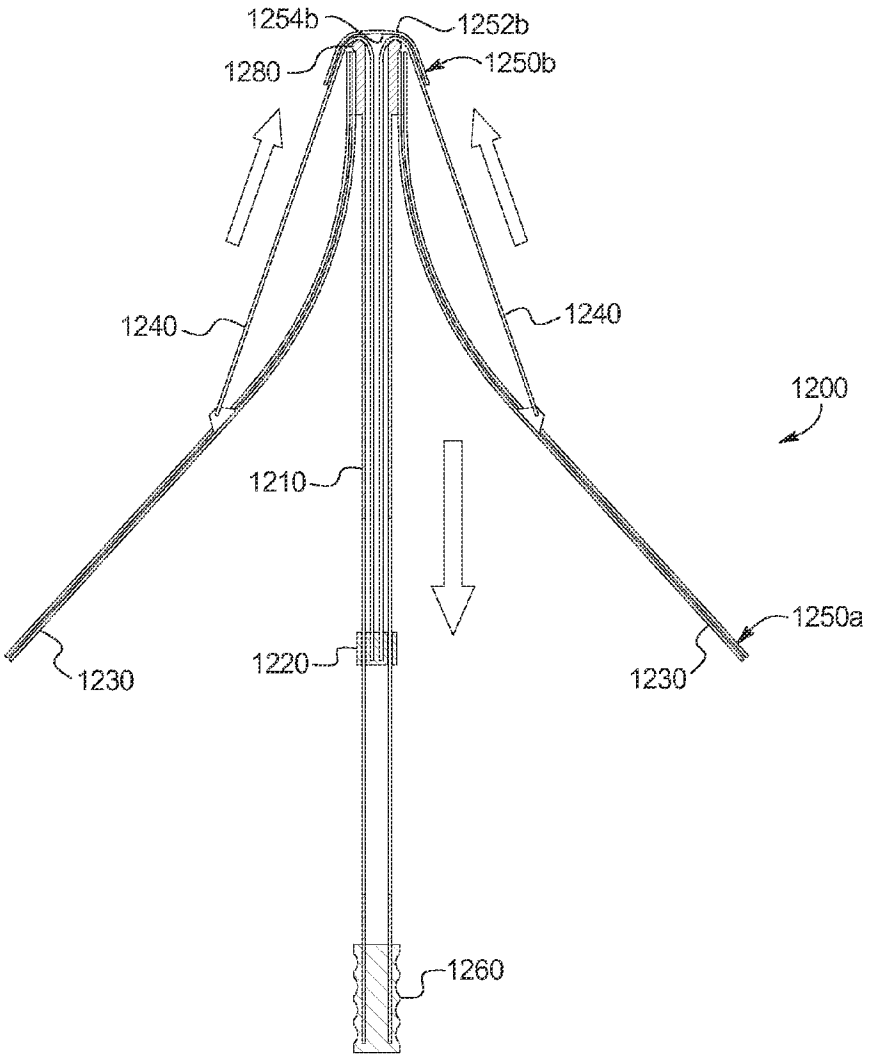
FIG. 25 is a cross-sectional view of the flexible umbrella of FIG. 22 in a half-open or half-unfolded configuration.
Figure 26:
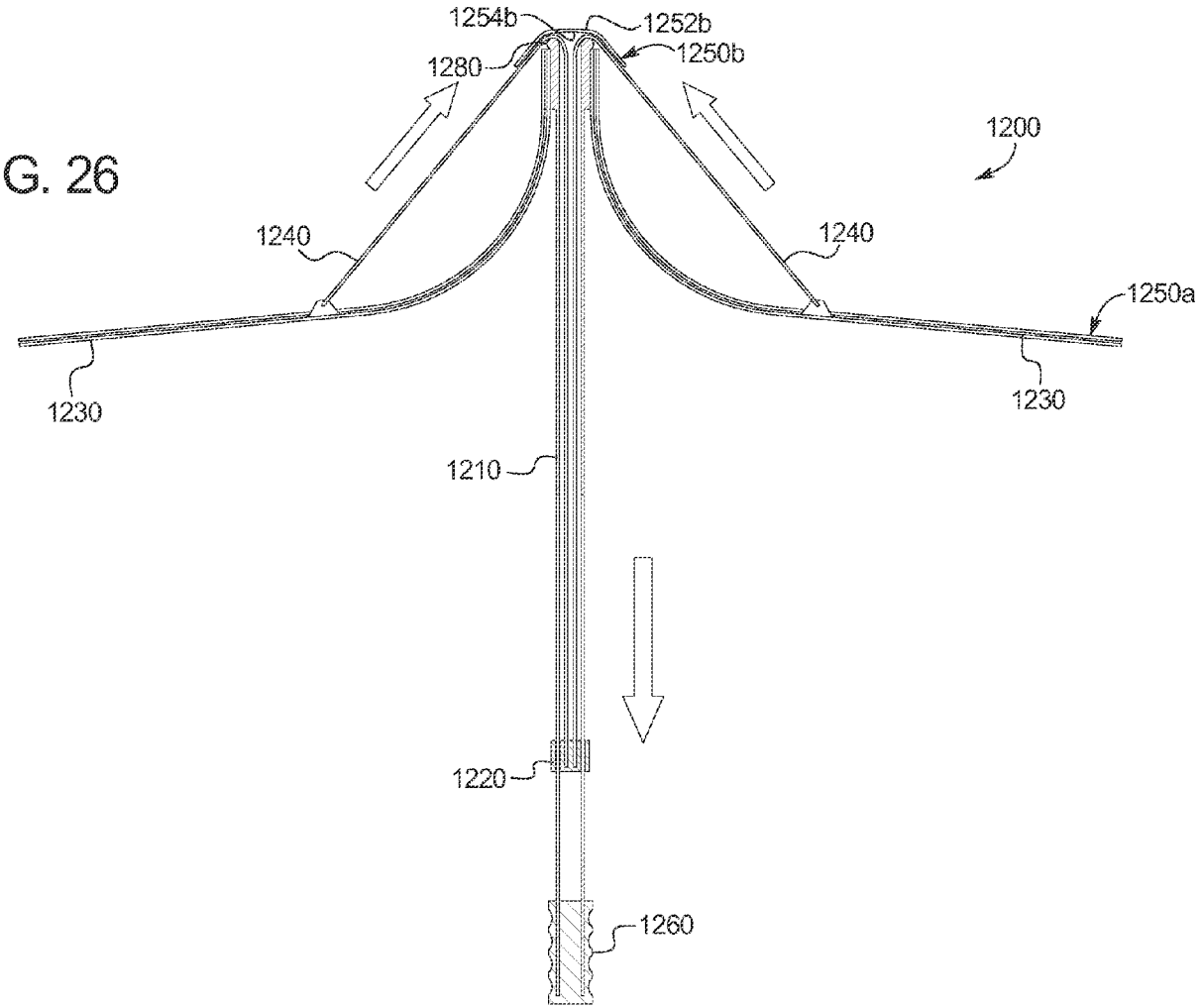
FIG. 26 is a cross-sectional view of the flexible umbrella of FIG. 22 in the unfolded configuration.

In one embodiment, as shown in FIG. 16A, the restrainer 380 is slidably coupled to the central shaft 310 rather than fixed to the central shaft 310 (as in the embodiment described above with respect to FIGS. 12 to 16). In this embodiment, the user moves the slidable restrainer 380 upward to adjust the pressure or force that the tensioners exert on the sheaths 335. Moving the slidable restrainer 380 upward reduces the distance between the slidable restrainer 380 and the connection point between the tensioners 340 and the sheaths 335, thereby increasing the downward curvature of the supports 330 and the membrane 350.

Fourth Example Embodiment

FIGS. 17, 18, 19, 20, and 21 show another example embodiment of the flexible umbrella of the present disclosure, which is generally indicated by numeral 1100. More specifically, this embodiment is an alternative embodiment of the flexible umbrella 100 illustrated in FIGS. 1, 2, 3, 3A, 4, and 5 and described above. In this illustrated embodiment, flexible umbrella 1100 does not include any sheaths. Thus, in this embodiment, the supports 1130 directly connect to their corresponding tensioners 1140 and to the membrane 1150. Additionally, in this embodiment, the tensioners are ropes rather than fabric ribbons.

Fifth Example Embodiment

FIGS. 22, 23, 24, 25, and 26 show another example embodiment of the flexible umbrella of the present disclosure, which is generally indicated by numeral 1200. More specifically, this embodiment is an alternative embodiment of the flexible umbrella 200 illustrated in FIGS. 7, 8, 9, 9A, 10, and 11 and described above. In this illustrated embodiment, flexible umbrella 1200 does not include any sheaths. Thus, in this embodiment, the supports 1230 directly connect to their corresponding tensioners 1240, to the membrane 1250, and to the upper end of the central shaft 1210. Additionally, in this embodiment, the tensioners are ropes rather than fabric ribbons.

Sixth Example Embodiment

FIGS. 27, 28, 29, 30, and 31 show another example embodiment of the flexible umbrella of the present disclosure, which is generally indicated by numeral 1300. More specifically, this embodiment is an alternative embodiment of the flexible umbrella 300 illustrated in FIGS. 12, 13, 14, 14A, 15, and 16 and described above. In this illustrated embodiment, flexible umbrella 1300 does not include any sheaths. Thus, in this embodiment, the supports 1330 directly connect to their corresponding tensioners 1340, the support securing hub 1390, and the membrane 1350. Additionally, in this embodiment, the tensioners are ropes rather than fabric ribbons.

In this example embodiment, the flexible umbrella 1300 includes a central shaft 1310 having a first, lower end and a second, upper end; a support securing hub 1390; a sliding collar 1320 including a plurality of radially spaced sets of tensioner receiving slots (as described above); a plurality of supports 1330 each having a first, lower end and a second, upper end; a plurality of tensioners 1340 each having a first, lower end and a second, upper end; a membrane 1350 having an upper surface 1352 and a lower surface 1354; a handle 1360; and a restrainer 1380.

In this embodiment, the handle 1360 is connected to the first, lower end of the central shaft 1310; the support securing hub 1390 is connected to and surrounds the central shaft 1310 near the second, upper end of the central shaft 1310; and the sliding collar 1320 is slidably connected to and surrounds the central shaft 1310 between the handle 1360 and the sheath securing hub 1390.

In this illustrated embodiment, each tensioner 1340 is connected at its first, lower end to the sliding collar 1320 via the tensioner receiving slots (as described above) and at its second, upper end to one of the tensioners 1340. The restrainer 1380 is fixed to the central shaft 1310 at a designated position along the central shaft 1310. That is, in this illustrated embodiment, the restrainer 1380 is not configured to slide relative to the central shaft 1310. The restrainer 1380 surrounds the central shaft 1310, the supports 1330, and the tensioners 1340.

Figure 27:
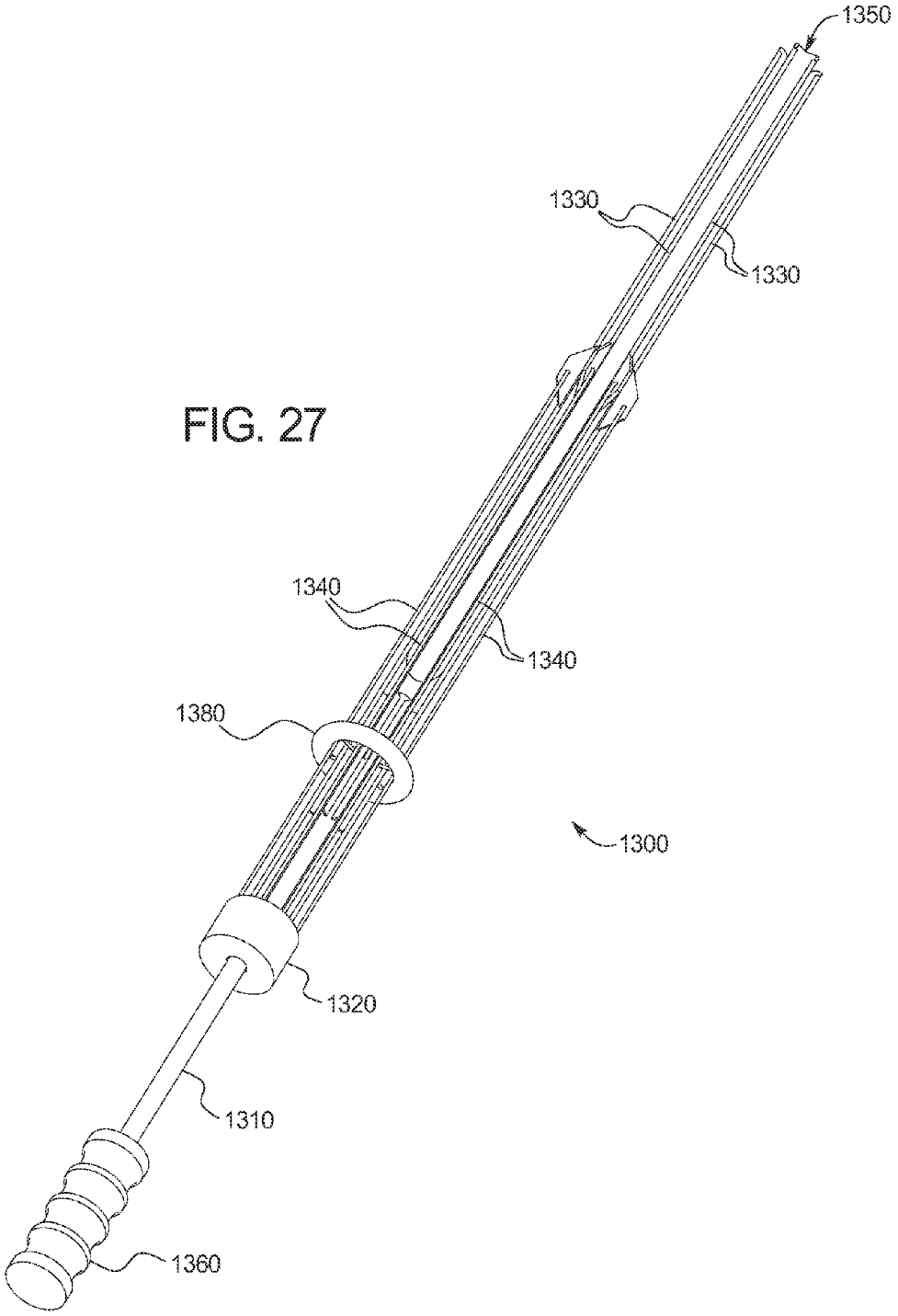
FIG. 27 is a bottom perspective view of another example embodiment of the flexible umbrella of the present disclosure in a dosed or folded configuration.
Figure 29:
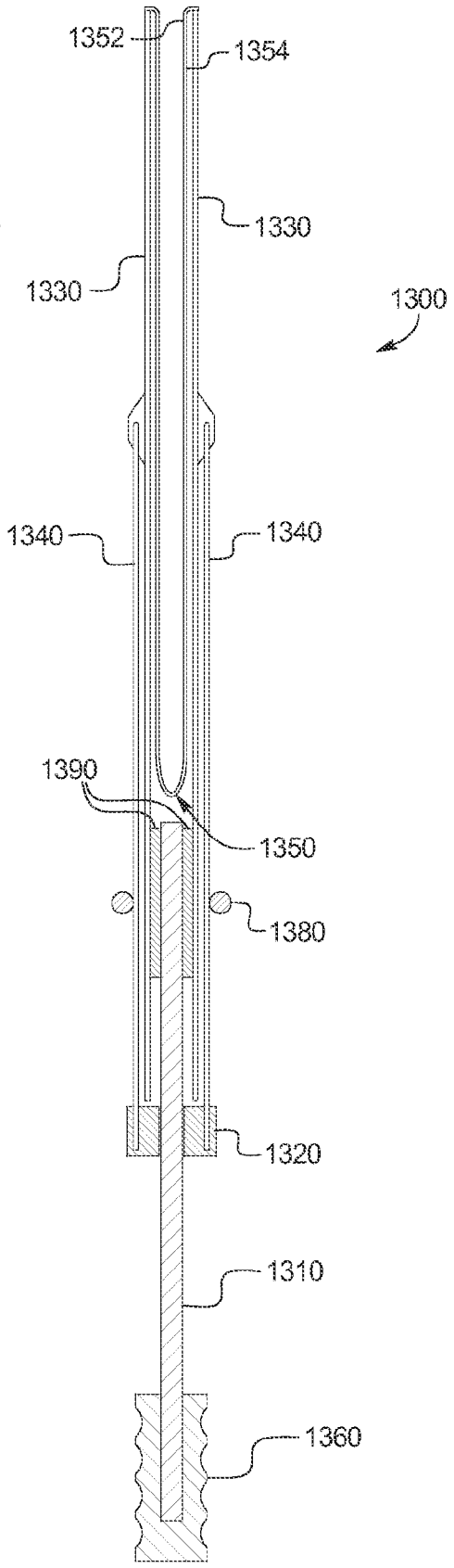
FIG. 29 is a cross-sectional view of the flexible umbrella of FIG. 27 in the folded configuration.

It should be appreciated that the supports are connected to the support securing hub and the membrane such that when the flexible umbrella is in a closed or folded configuration, as illustrated in FIGS. 27 and 29 (described below), the supports are oriented in relatively the same orientation as the central shaft. Further, in this illustrated embodiment, the connection points of the second, upper ends of the tensioners to their corresponding supports are chosen such that the tensioners are relatively taught when the flexible umbrella is in the folded configuration. In other words, for each tensioner in this embodiment, the distance between the connection point of the first, lower end of that tensioner to the sliding collar and the connection point of the second, upper end of that tensioner to its corresponding support is about equal to the length of that tensioner.

Turning to FIGS. 27 and 29, as noted above, FIG. 27 illustrates a bottom perspective view of the flexible umbrella 1300 in the folded configuration and FIG. 29 illustrates a cross-sectional view of the flexible umbrella 1300 in the folded configuration. When the flexible umbrella 1300 is in the folded configuration, the sliding collar 1320 is positioned near the center of the central shaft 1310, the supports 1330 and the tensioners 1340 are oriented in relatively the same orientation as the central shaft 1310, and the membrane 1350 is folded inward such that opposing halves of upper surface 1352 of the membrane 1350 face one another. To cause the flexible umbrella 1300 to shift from the folded configuration into an open or unfolded configuration, a user applies downward pressure to the sliding collar 1320.

Figure 30:
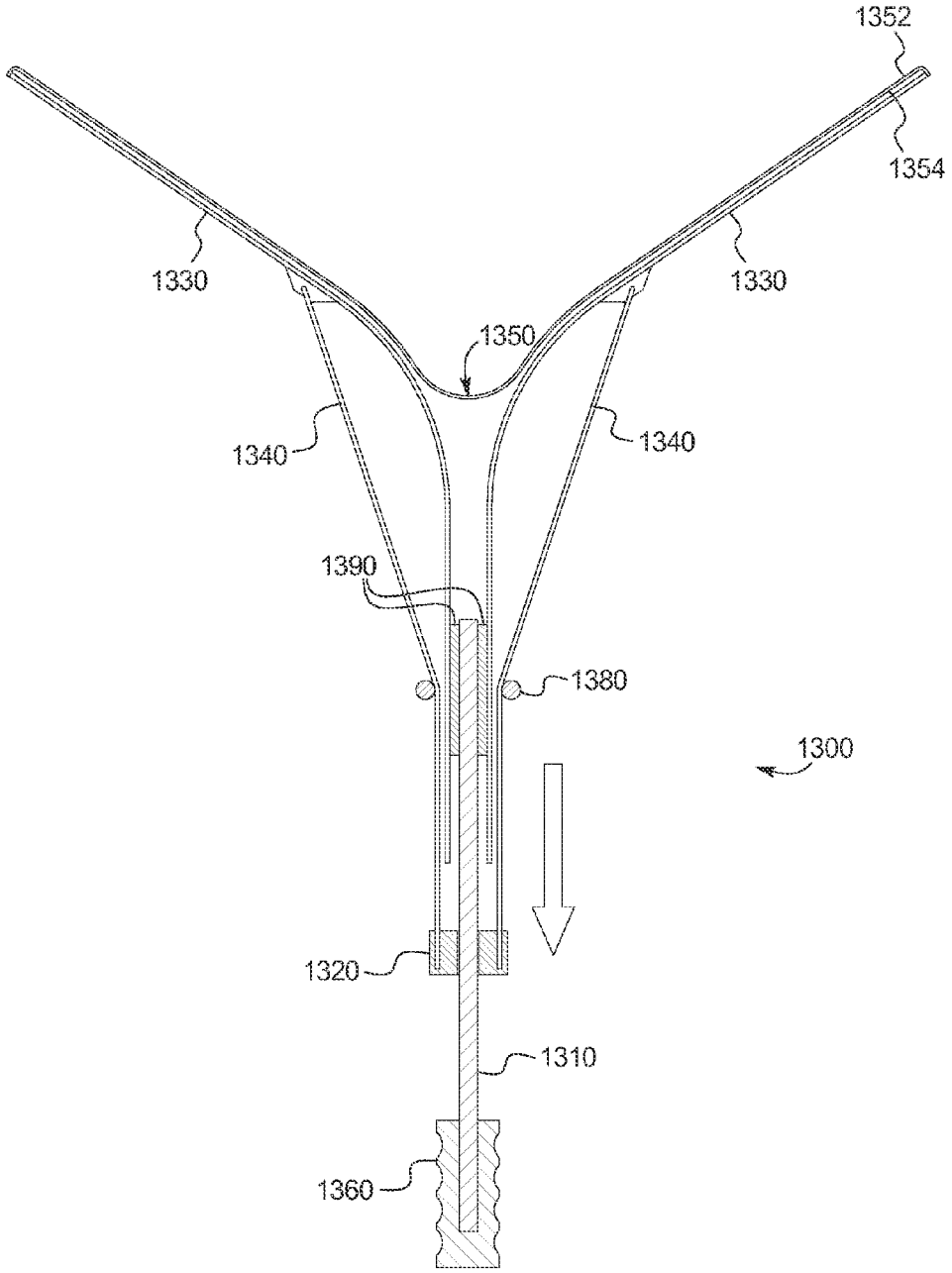
FIG. 30 is a cross-sectional view of the flexible umbrella of FIG. 27 in a half-open or half-unfolded configuration.

Turning to FIG. 30, FIG. 30 illustrates a cross-sectional view of the flexible umbrella 1300 in a half-open or half-unfolded configuration. When the user applies downward pressure to the sliding collar 1320, the sliding collar 1320 and the tensioners 1340 (which are connected to the sliding collar 1320) begin moving downward relative to the central shaft 1310. As the sliding collar 1320 and the tensioners 1340 move downward, the tensioners 1340 become taught and cause tensile forces to be applied to their corresponding supports 1330. For each support 1330 and corresponding tensioner 1340, this tensile force originates at the connection point between that support 1330 and that tensioner 1340, and is applied from that point in a direction along that tensioner 1340 toward the point at which that tensioner contacts the restrainer 1380. These tensile forces cause the supports 1330 to bend downward. As the supports 1330 bend downward, the connections between the supports 1330 and the membrane 1350 cause the membrane 1350 to begin to unfold.

Figure 28:
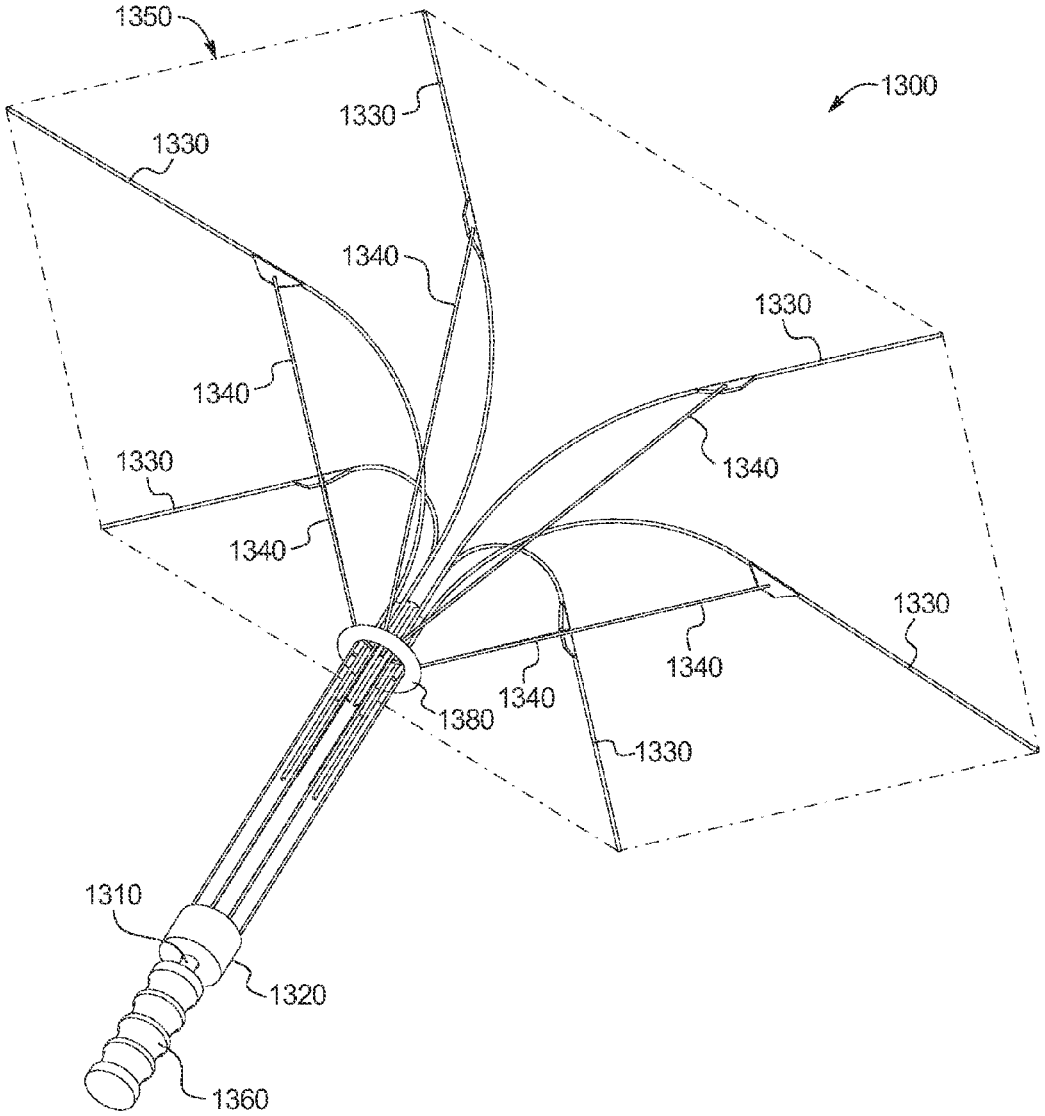
FIG. 28 is a bottom perspective view of the embodiment of the flexible umbrella of FIG. 27 in an open or unfolded configuration.
Figure 31:
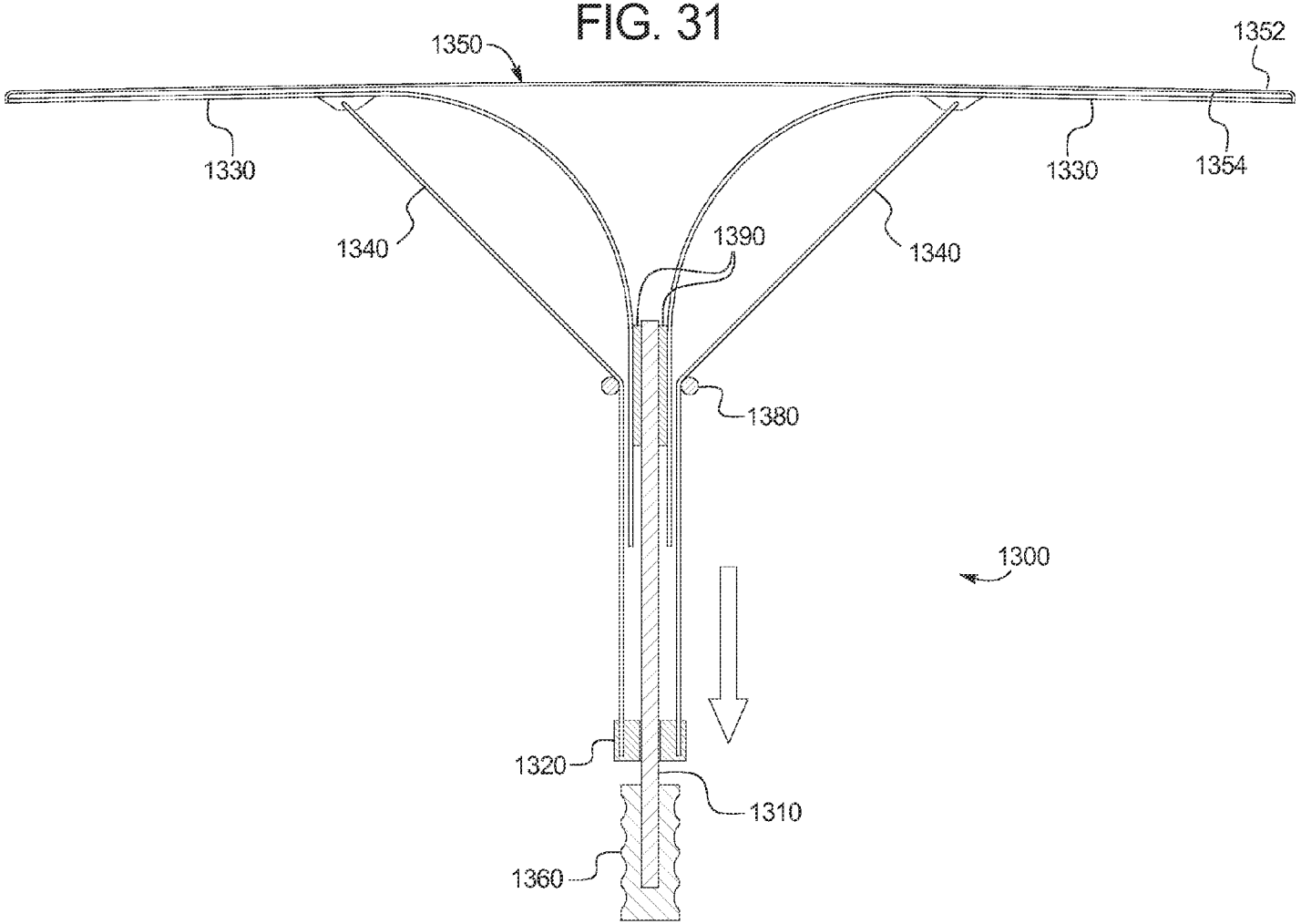
FIG. 31 is a cross-sectional view of the flexible umbrella of FIG. 27 in the unfolded configuration.

The user moves the sliding collar 1320 downward until the sliding collar 1320 reaches a designated locking position along the central shaft 1310. Once the sliding collar 1320 reaches the designated locking position, a locking mechanism (not shown) engages the sliding collar 1320 and locks the sliding collar 1320 in place relative to the central shaft 1310. The sliding collar 1320 remains locked in place until the user disengages the sliding collar 1320 from the locking mechanism. When the sliding collar 1320 reaches the locking position, the flexible umbrella 1300 is in the unfolded configuration. FIG. 28 illustrates a bottom perspective view of the flexible umbrella in the unfolded configuration and FIG. 31 illustrates a cross-sectional view of the flexible umbrella 1300 in the unfolded configuration.

Other Embodiments

As noted above, the present disclosure is not limited to flexible umbrellas including handles. In certain embodiments, the flexible canopy does not include a handle. In one such embodiment, the flexible canopy includes a base or stand. In another such embodiment, the central shaft of the flexible canopy is insertable into a base or stand either temporarily (such that it is removable from the base or stand) or permanently (such that it is not removable from the base or stand). In one such embodiment, the base or stand is a weighted base or stand. In another such embodiment, the base or stand is a portable or a movable base or stand. In another such embodiment, the base or stand is an immovable base or stand, such as one encased in concrete or otherwise anchored in place. In other embodiments, the flexible canopy does not include a handle or a base or stand.

It should be appreciated that the bases or stands of a plurality of flexible canopies may be positioned such that when those flexible canopies are in the unfolded configuration, their membranes are oriented such that they form a single relatively congruous membrane. For instance, a plurality of flexible canopies having square membranes may be positioned adjacent one another such that when those canopies are in the unfolded configuration, their membranes form a single relatively congruous square or rectangular membrane. It should be appreciated that canopies of any suitable shapes may be used in such a manner to form one or more congruous membranes.

In the embodiments of the flexible canopy described above and illustrated in the accompanying Figures, the membrane or membranes are generally symmetrical about the central shaft. For instance, in an example flexible canopy in which the membrane has a circular shape, the central shaft and the membrane are positioned such that the second, upper end of the central shaft is at the center of the membrane. In other embodiments, however, the membrane is eccentric or asymmetrical about the central shaft. For instance, in another example flexible canopy in which the membrane has a circular shape, the central shaft and the membrane are positioned such that the second, upper end of the central shaft is offset from the center of the membrane.

Additionally, in the embodiments of the flexible canopy described above and illustrated in the accompanying Figures, the membrane or membranes are oriented substantially horizontally when the flexible canopies are in the unfolded configuration. For instance, the flexible canopy illustrated in FIG. 16 includes a substantially horizontal membrane when the flexible canopy is in the unfolded configuration. In other embodiments, however, the membrane may be angled relative to the horizontal (such as at a ten degree angle, a twenty degree angle, a thirty degree angle, or any other suitable angle) when in the unfolded configuration.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A canopy comprising:

a handle;

a central shaft connected to the handle;

a plurality of supports separate and distinct from the central shaft, wherein, for each of the supports: (a) said support includes a first end, an opposing second end, and a body extending between the first end and the second end; and (b) a first portion of the body of said support is fixedly connected to the central shaft such that said support is spaced apart from the handle;

a membrane connected to each of the supports;

a collar surrounding the central shaft and slidably connected to the central shaft such that the collar is movable toward the handle to cause the membrane to shift from a folded configuration to an unfolded configuration; and a plurality of tensioners, each of the tensioners having a first end connected to the collar and a second end connected to one of the supports at a fixed location along said support, wherein:

(a) when the membrane is in the folded configuration, each of the supports has an undeformed shape;

(b) when the collar is moved toward the handle to cause the membrane to shift from the folded configuration to the unfolded configuration, the tensioner connected to said support exerts a tensile force on said support that causes said support to bend such that the second end of each support moves toward the handle and radially outward relative to the central shaft; and (c) when the membrane is in the unfolded configuration, for each of the supports: (i) said support is biased to return to the undeformed shape and exerts a tensile force on the tensioner connected to said support, and (ii) the tensioner connected to said support exerts a tensile force on said support and prevents said support from returning to the undeformed shape.

2. The canopy of claim 1, wherein the undeformed shape is a substantially straight line.

3. The canopy of claim 1, which includes a restrainer connected to the central shaft and surrounding the tensioners, the supports, and the central shaft.

4. The canopy of claim 1, which includes a locking mechanism configured to engage the collar and lock the collar in place relative to the central shaft when the collar reaches a designated locking location along the central shaft and the membrane is in the unfolded configuration.

5. The canopy of claim 4, wherein disengagement of the locking mechanism from the collar enables the collar to move away from the handle via the biasing of the supports to the undeformed shape to cause the membrane to shift from the unfolded configuration to the folded configuration.

6. The canopy of claim 1, wherein at least one of the tensioners includes a rope.

7. The canopy of claim 1, wherein at least one of the tensioners includes a fabric strip.

8. The canopy of claim 1, wherein the plurality of supports are not connected to the collar.

9. The canopy of claim 1, wherein when the collar is moved away from the handle to cause the membrane to shift from the unfolded configuration to the folded configuration, the second end of each support moves away from the handle and radially inward relative to the central shaft to return said support to the undeformed shape.

10. The canopy of claim 1, wherein when the membrane is in the unfolded configuration, for each support, a longitudinal axis of the first portion of the body of said support is substantially perpendicular to a longitudinal axis of a second portion of the body of said support.

11. The canopy of claim 10, wherein when the membrane is in the folded configuration, for each support, the longitudinal axis of the first portion of the body of said support is substantially coaxial with the longitudinal axis of the second portion of the body of said support.

12. The canopy of claim 1, wherein the membrane is substantially flat when in the unfolded configuration.

13. A canopy comprising:

a central shaft including a first end and an opposing second end;

a plurality of supports separate and distinct from the central shaft, wherein, for each of the supports: (a) said support includes a first end, an opposing second end, and a body extending between the first end and the second end; and (b) a first portion of the body of said support is fixedly connected to the central shaft such that said support is spaced apart from the second end of the central shaft;

a membrane connected to each of the supports;

a collar surrounding the central shaft and slidably connected to the central shaft such that the collar is movable toward the second end of the central shaft to cause the membrane to shift from a folded configuration to an unfolded configuration; and a plurality of tensioners, each of the tensioners having a first end connected to the collar and a second end connected to one of the supports at a fixed location along said support, wherein:

(a) when the membrane is in the folded configuration, each of the supports has an undeformed shape;

(b) when the collar is moved toward the second end of the central shaft to cause the membrane to shift from the folded configuration to the unfolded configuration, the tensioner connected to said support exerts a tensile force on said support that causes said support to bend such that the second end of each support moves toward the second end of the central shaft and radially outward relative to the central shaft; and (c) when the membrane is in the unfolded configuration, for each of the supports: (i) said support is biased to return to the undeformed shape and exerts a tensile force on the tensioner connected to said support, and (ii) the tensioner connected to said support exerts a tensile force on said support and prevents said support from returning to the undeformed shape.

14. The canopy of claim 13, wherein the undeformed shape is a substantially straight line.

15. The canopy of claim 13, wherein the central shaft is insertable into a base.

16. The canopy of claim 13, which includes a restrainer connected to the central shaft and surrounding the tensioners, the supports, and the central shaft.

17. The canopy of claim 13, which includes a locking mechanism configured to engage the collar and lock the collar in place relative to the central shaft when the collar reaches a designated locking location along the central shaft and the membrane is in the unfolded configuration.

18. The canopy of claim 17, wherein disengagement of the locking mechanism from the collar enables the collar to move away from the second end of the central shaft via the biasing of the supports to the undeformed shape to cause the membrane to shift from the unfolded configuration to the folded configuration.

19. The canopy of claim 13, wherein at least one of the tensioners includes a rope.

20. The canopy of claim 13, wherein at least one of the tensioners includes a fabric strip.

21. The canopy of claim 13, wherein the plurality of supports are not connected to the collar.

22. The canopy of claim 13, wherein when the collar is moved away from the second end of the central shaft to cause the membrane to shift from the unfolded configuration to the folded configuration, the second end of each support moves away from the second end of the central shaft and radially inward relative to the central shaft to return said support to the undeformed shape.

23. The canopy of claim 13, wherein when the membrane is in the unfolded configuration, for each support, a longitudinal axis of the first portion of the body of said support is substantially perpendicular to a longitudinal axis of a second portion of the body of said support.

24. The canopy of claim 13, wherein when the membrane is in the folded configuration, for each support, the longitudinal axis of the first portion of the body of said support is substantially coaxial with the longitudinal axis of the second portion of the body of said support.

25. The canopy of claim 13, wherein the membrane is substantially flat when in the unfolded configuration.

26. A canopy comprising:

a handle;

a central shaft connected to the handle;

a plurality of supports separate and distinct from the central shaft, a first end of each of the supports being fixedly connected to the central shaft such that said support is spaced apart from the handle, each of the supports having an undeformed shape to which said support is biased to return;

a membrane connected to each of the supports;

a collar surrounding the central shaft and slidably connected to the central shaft such that the collar is movable toward the handle to cause the membrane to shift from a folded configuration to an unfolded configuration; and a plurality of flexible tensioners, wherein each of the flexible tensioners:

(a) has a first end connected to the collar and a second end connected to one of the supports at a fixed location along said support such that, when the collar is moved toward the handle to cause the membrane to shift from the folded configuration to the unfolded configuration, the flexible tensioner connected to said support exerts a tensile bending force on said support that causes said support to bend such that a second end of said support opposite the first end of said support moves toward the handle and radially outward relative to the central shaft;

(b) has a first shape when the membrane is in the folded configuration and a second different shape when the membrane is in the unfolded configuration;

(c) when the membrane is in the folded configuration, is not biased to return to the second shape; and (d) when the membrane is in the unfolded configuration, is under tension and biased by the support to which said flexible tensioner is attached to return to the first shape.

27. A canopy comprising:

a central shaft including a first end and an opposing second end;

a plurality of supports separate and distinct from the central shaft, a first end of each of the supports being fixedly connected to the central shaft such that said support is spaced apart from the second end of the central shaft, each of the supports having a undeformed shape to which said support is biased to return;

a membrane connected to each of the supports;

a collar surrounding the central shaft and slidably connected to the central shaft such that the collar is movable toward the second end of the central shaft to cause the membrane to shift from a folded configuration to an unfolded configuration; and a plurality of flexible tensioners, wherein each of the flexible tensioners:

(a) has a first end connected to the collar and a second end connected to one of the supports at a fixed location along said support such that, when the collar is moved toward the second end of the central shaft to cause the membrane to shift from the folded configuration to the unfolded configuration, the flexible tensioner connected to said support exerts a tensile bending force on said support that causes said support to bend such that a second end of said support opposite the first end of said support moves toward the second end of the central shaft and radially outward relative to the central shaft;

(b) has a first shape when the membrane is in the folded configuration and a second different shape when the membrane is in the unfolded configuration;

(c) when the membrane is in the folded configuration, is not biased to return to the second shape; and (d) when the membrane is in the unfolded configuration, is under tension and biased by the support to which said flexible tensioner is attached to return to the first shape.

* * * * *